US008348224B2

(12) United States Patent
McDonagh

(10) Patent No.: US 8,348,224 B2
(45) Date of Patent: Jan. 8, 2013

(54) TIE SYSTEM FOR FORMING POURED CONCRETE WALLS OVER CONCRETE FOOTINGS

(75) Inventor: Greg McDonagh, Providence, UT (US)

(73) Assignee: Paladin Industrial, LLC, Millville, UT (US)

( * ) Notice: Subject to any disclaimer, the term of this patent is extended or adjusted under 35 U.S.C. 154(b) by 1205 days.

(21) Appl. No.: 12/080,573

(22) Filed: Apr. 3, 2008

(65) Prior Publication Data

US 2009/0249725 A1 Oct. 8, 2009

(51) Int. Cl.
*E04G 17/12* (2006.01)
*E04G 11/08* (2006.01)

(52) U.S. Cl. ..... 249/216; 249/34

(58) Field of Classification Search ..... 249/34, 249/213, 216; 52/426, 442
See application file for complete search history.

(56) References Cited

U.S. PATENT DOCUMENTS

| | | | | | |
|---|---|---|---|---|---|
| 1,224,810 | A | * | 5/1917 | Tenholder | 249/216 |
| 2,490,228 | A | * | 12/1949 | Pontiere | 249/216 |
| 3,722,849 | A | * | 3/1973 | Luyben | 249/34 |
| 3,778,020 | A | * | 12/1973 | Burrows et al. | 249/34 |
| 4,604,843 | A | * | 8/1986 | Ott et al. | 52/426 |
| 4,669,234 | A | | 6/1987 | Wilnau | |
| 4,924,641 | A | | 5/1990 | Gibbar et al. | |
| 4,949,515 | A | | 8/1990 | Krecke | |
| 5,038,541 | A | | 8/1991 | Gibbar et al. | |
| 5,140,794 | A | | 8/1992 | Miller | |
| 5,207,931 | A | * | 5/1993 | Porter | 249/213 |
| 5,459,971 | A | * | 10/1995 | Sparkman | 52/426 |
| 5,566,518 | A | * | 10/1996 | Martin et al. | 52/426 |
| 5,570,552 | A | | 11/1996 | Nehring | |
| 5,611,182 | A | | 3/1997 | Spude | |
| 5,809,726 | A | | 9/1998 | Spude | |
| 5,922,236 | A | | 7/1999 | Zuhl | |
| 5,992,114 | A | | 11/1999 | Zelinsky et al. | |
| 6,134,861 | A | | 10/2000 | Spude | |
| 6,230,462 | B1 | * | 5/2001 | Beliveau | 52/426 |
| 6,250,033 | B1 | * | 6/2001 | Zelinsky | 52/426 |
| 6,293,067 | B1 | | 9/2001 | Meendering | |
| 6,419,205 | B1 | | 7/2002 | Meendering | |
| 6,474,033 | B1 | * | 11/2002 | Luchini et al. | 52/426 |
| 6,739,102 | B2 | | 5/2004 | Roy et al. | |
| 6,792,729 | B2 | * | 9/2004 | Beliveau | 52/426 |
| 7,082,732 | B2 | * | 8/2006 | Titishov | 52/426 |
| 7,284,351 | B2 | | 10/2007 | Cooper et al. | |
| 7,775,499 | B2 | * | 8/2010 | Metcalf | 249/34 |
| 7,827,752 | B2 | * | 11/2010 | Scherrer | 52/426 |
| 2002/0124508 | A1 | * | 9/2002 | Dunn et al. | 52/426 |
| 2004/0045238 | A1 | * | 3/2004 | Dunn et al. | 52/426 |

* cited by examiner

*Primary Examiner* — Michael Safavi
(74) *Attorney, Agent, or Firm* — David L. Stott

(57) ABSTRACT

A tie system and method for forming a wall from a hardenable pourable building material. In one embodiment, the tie system includes multiple ties configured to be directly interconnected into a vertically extending tie stack such that multiple tie stacks can be positioned over a footing in a spaced apart arrangement. The multiple tie stacks are configured to extend substantially perpendicular between substantially parallel panel structures. Each tie stack includes a base tie and one or more wall ties, each of which directly attach to each other in a vertically stacked arrangement.

19 Claims, 17 Drawing Sheets

TIE SYSTEM FOR FORMING POURED CONCRETE WALLS OVER CONCRETE FOOTINGS

TECHNICAL FIELD

The present invention relates generally to wall forming systems. More specifically, the present invention relates to a tie system for forming foundation walls and the like.

BACKGROUND

Many residential and light commercial structures are built on concrete foundation walls which are formed by pouring concrete into a system of forms that have been erected on a previously poured concrete footing. After the concrete has cured sufficiently, the forms are stripped from the concrete and in most cases soil is back filled on the exterior side of the concrete wall. Typically, the base of each foundation wall is supported on a concrete footing, which is wider than the thickness of the wall itself. Ideally, the centerline of the wall is aligned with the centerline of the footing. The footing spreads the load of the structure over a greater area and prevents uneven loading of the foundation wall.

As set forth, once the footing is in place and hardened, a system of forms are constructed over the footing. Such system of forms have typically been constructed using expensive and reusable forms. These forms are typically made of metal and are, thus, very heavy and extremely labor-intensive to assemble and remove after pouring the concrete. Further, due to the significant investment of reusable metal forms, concrete laborers will typically pass the cost on to others for their services. As a result, various other concrete form systems for cement walls have been proposed as alternatives to the heavy metal forms.

One recent development in this field is the use of expanded polystyrene panels, known as insulated concrete forms. These newer form systems utilize pairs of horizontally extending foam panels which are connected in parallel with a series of rigid plastic ties. Complete wall form systems are typically created by vertically stacking these horizontally extending paired foam panels into larger arrays. Concrete is then poured between the panels of the completed foam wall form system. The thickness of the poured concrete walls can be adjusted by the selection and utilization of form ties of appropriate size. Subsequent to concrete hardening these foam panels are left in place to serve as insulation.

Although such insulated concrete forms are lighter than the conventional metal form systems, the forms are bulky and, therefore, the cost for shipping such forms can be expensive. Further, due to the bulky and cumbersome nature of these forms, they are highly susceptible to the inherent risk of damage during transportation and even during installation. Another problem with the insulated concrete forms is the requirement for numerous different types of parts to fit the variations of the footprint of both residential and commercial construction. Due to these numerous different parts and sizes, the insulated concrete forms are high in cost to manufacture and therefore, such high cost is past on to the consumers and builders. Furthermore, the numerous different types of parts in the insulated concrete forms are complicated to construct and require skilled laborers who understand the complexities for such construction. In addition, another inherent problem with the insulated concrete forms is the difficulty to match such forms to the predetermined required lengths along the footing usually evident at corners and ends, in which shortening the forms by cutting and then adhesively repairing the forms is required, often leaving the forms in a damaged state with reduced structural integrity. Such problem further increases the complexity and time required to build the forms in preparation to pour the concrete.

Another problem with prior art systems, particularly conventional metal forms, involves the installation of rebar, wire mesh, or other reinforcing members between the parallel panels that are to be embedded within the finished foundation wall. The techniques employed typically involve various means and methods for suspending rebar haphazardly between the panels with wire ties. Although such wire ties have been used for years, inaccurate placement of the rebar is common, often resulting in unsatisfactory reinforcement of the foundation walls. Further, such wire tying techniques are labor intensive, time consuming and a tedious process.

Based on the foregoing, it would be advantageous to provide a concrete form system that is low in cost for builders and, thus, the home owner, minimizes the waste of form materials, provides a non-complicated system with less part types and that inherently can be adjusted to any required lengths for ends and corners or overall footprints required for the foundation walls. Further, it would be advantageous to provide a concrete form system that is less labor intensive, light weight and compact and, further, provides for ready and precise assembly of reinforcing rebar materials to be placed in concrete forms.

BRIEF SUMMARY OF THE INVENTION

The present invention is directed to a tie system configured to support forms for a hardenable pourable building material. In one embodiment, the tie system includes a base tie and a wall tie. The base tie includes an elongated portion extending between a first end portion and a second end portion. The first end portion and the second end portion each include an attachment portion, wherein the base tie is configured to be oriented laterally over a length of a footing. The wall tie includes a first elongated wall portion and a second elongated wall portion with a cross-member extending therebetween. With this arrangement, the first elongated wall portion and the second elongated wall portion are configured to extend vertically from and attach to the attachment portion of the first end portion and the second end portion, respectively, of the base tie.

In another embodiment of the present invention, the tie system includes multiple ties configured to be directly interconnected into a vertically extending tie stack such that multiple tie stacks can be positioned over a footing in a spaced and separate arrangement, in which the multiple tie stacks are configured to extend substantially perpendicular between substantially parallel panel structures. Each tie stack includes a base portion and a wall portion. Such a base portion includes a first end portion and a second end portion, wherein the first end portion defines a first channel therein, which first channel is configured to receive a first panel structure. Likewise, the second end portion defines a second channel therein that is configured to receive a second panel structure. The wall portion includes a first elongated wall portion and a second elongated wall portion with a cross-member extending therebetween. The first and second elongated wall portions are configured to extend vertically from and are directly interconnected to the respective first and second end portions of the base portion. With such an arrangement, the first and second elongated wall portions are configured to be fastened to the respective first and second panel structures.

In still another embodiment, the present invention is directed to a wall forming system. Such wall forming system includes a plurality of base ties and a plurality of wall ties. The plurality of base ties each include an elongated portion that is configured to be secured to and oriented laterally along a length of a footing in a spaced arrangement. Each wall tie is configured to be interconnected to another wall tie to assemble multiple wall tie stacks. Each wall tie stack is configured to be stacked vertically to one base tie of the plurality of base ties. Further, each wall tie includes a first elongated wall portion and a second elongated wall portion with a cross-member extending therebetween. The first elongated wall portion and the second elongated wall portion each include an outward facing surface, in which each of the outward facing surfaces are configured to face in substantially opposite directions. Further, each of the outward facing surfaces is configured to be longitudinally oriented in a substantially vertical direction. With this arrangement, each of the outward facing surfaces is configured to be fastened to a panel structure.

BRIEF DESCRIPTION OF THE SEVERAL VIEWS OF THE DRAWINGS

To further clarify the above and other advantages and features of the present invention, a more particular description of the invention will be rendered by reference to specific embodiments thereof which are illustrated in the appended drawings. It is appreciated that theses drawings depict only typical embodiments of the invention and are therefore not to be considered limiting of its scope. The invention will be described and explained with additional specificity and detail through the use of the accompanying drawings in which.

DETAILED DESCRIPTION OF THE INVENTION

Figure 1:
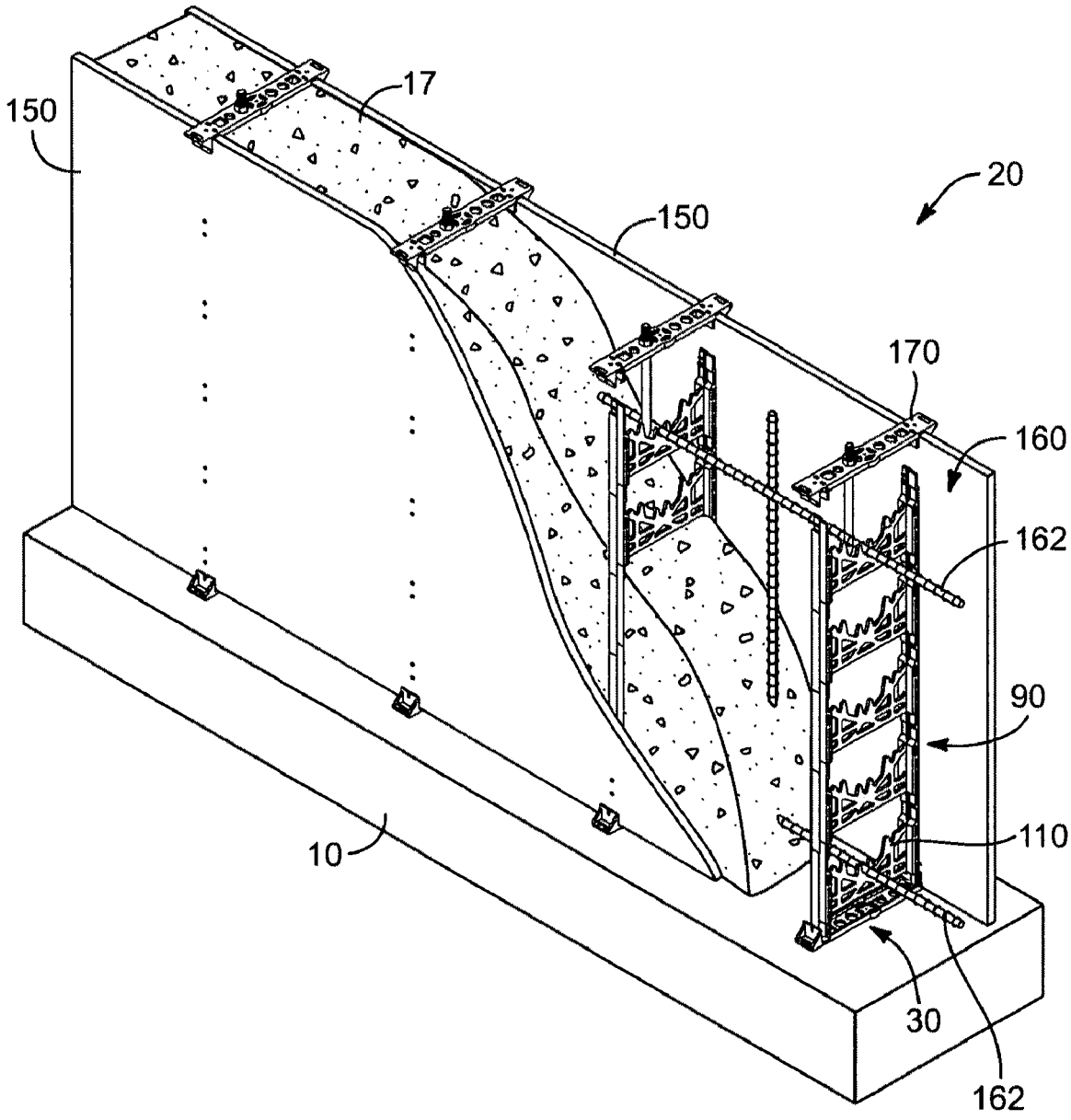
FIG. 1 is a perspective view of an assembled tie system and concrete wall with portions removed, according to one embodiment of the present invention.

Referring first to FIG. 1, there is disclosed a partial view of a tie system 20, according to the present invention. The primary components of the tie system 20 comprise a base tie 30 and a wall tie 90. As will be set forth herein, the base tie 30 and wall tie 90 are utilized as support structure in conjunction with panel structures 150, such as typical plywood or Form ply, to build concrete forms for forming concrete walls for various residential and commercial buildings.

Such a tie system 20 includes multiple base ties 30 and multiple wall ties 90. The base ties 30 are placed and secured, in a spaced apart arrangement, to a concrete footing 10. Each base tie 30 receives a stack of wall ties 90 configured to extend in a vertical arrangement to form a tie stack 160. Each of the wall ties 90, within a stack, are configured to be directly interconnected together and configured to extend vertically, one above another. After running a first course of wall ties 90, horizontal rebar 162 can be run along a cross-member 110 of the wall ties 90, after which, additional courses of wall ties 90 can be built upon each other, running horizontal rebar 162 as needed, until the tie stacks 160 are built to the desired height. Once the tie stacks 160 are complete, panel structures 150 can be placed along each side of the tie stacks 160 in a parallel fashion and secured thereto. In addition, a finish tie 170 is provided to be positioned over the panel structures 150. Concrete can then be poured between the parallel panel structures 150 and into the tie system 20. Once the concrete wall 17 has set, the panel structures 150 can then be removed and utilized for another tie system or for other purposes for the structure being built upon the concrete foundation. As readily understood by one of ordinary skill in the art, the tie system 20 of the present invention provides advantages of being low in material cost and is time efficient for forming concrete walls for both residential and commercial dwellings.

It should be noted that the tie system is described herein as a concrete wall forming system due to concrete typically being used in the art for foundation walls. However, the tie system of the present invention is not limited to concrete, but rather, the tie system can be employed with any hardenable liquid building material, including, but not limited to, typical concrete, various cement and/or concrete composites, (i.e., fiber reinforced cements, polymer composite cements), lightweight type cements or concrete, or any other suitable pourable and curable building material known in the art that will meet the structural integrity requirements for a given structure. Furthermore, as can be appreciated by one of ordinary skill in the art, the tie system of the present invention can be employed to form above ground level walls as well as foundation walls. In addition, it is intended that the term footing can mean any stable structure the base tie of the present invention can be mounted or secured to, such as, a concrete footing or even traditional concrete forms.

Figure 2:
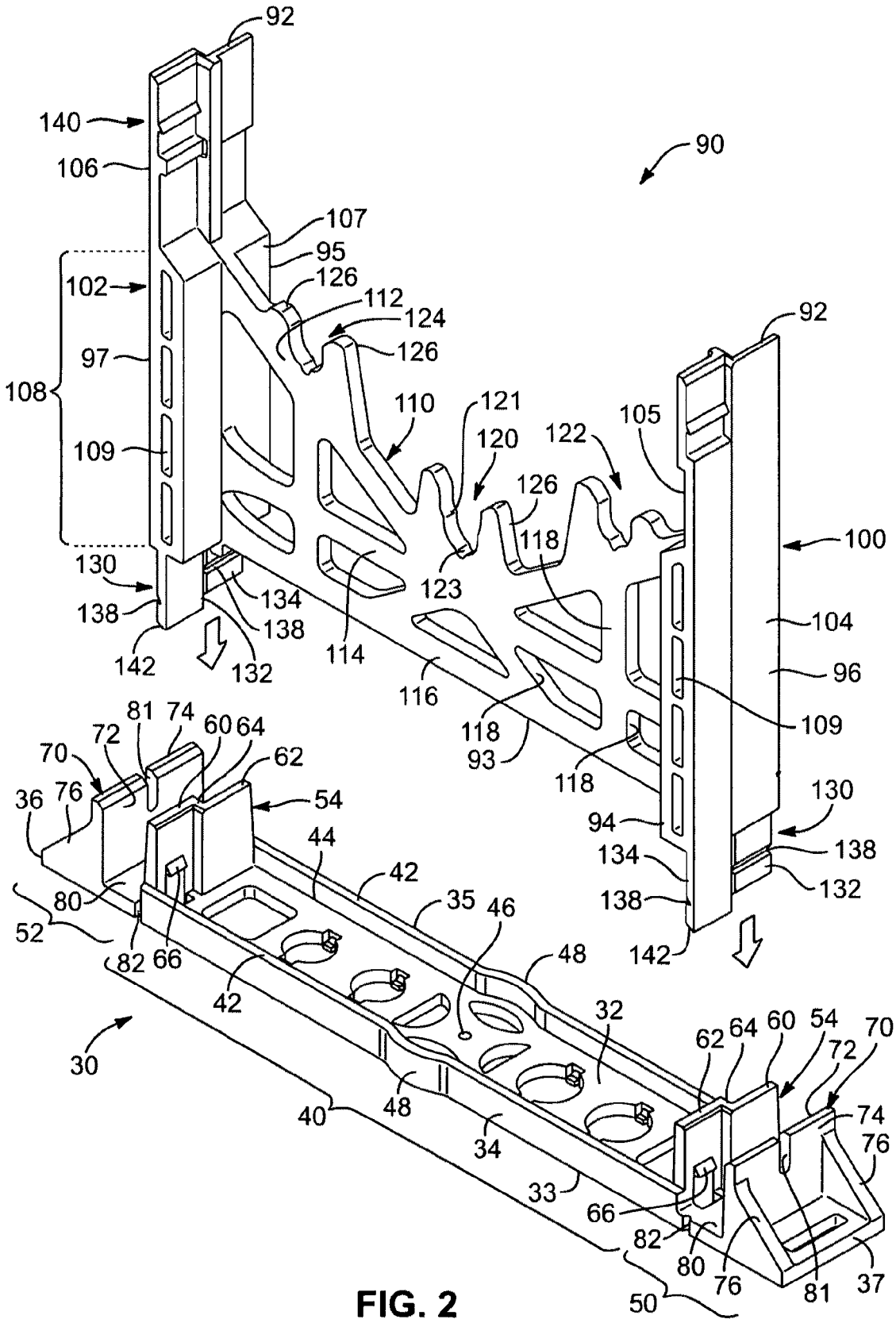
FIG. 2 is a perspective view of an unassembled base tie and wall tie, according to an embodiment of the present invention.

Now referring to FIG. 2, there is disclosed an enlarged unassembled view of the base tie 30 and the wall tie 90, according to an embodiment of the present invention. Such a base tie 30 and wall tie 90 include structural features that allow the tie system to be placed under maximum loads while pouring the concrete while still maintaining the structural integrity within the tie system. The base tie 30 and wall tie 90 are ideally made from a semi-rigid or substantially rigid polymeric material, such as high density polyethylene. Other polymeric materials can also be used, such as, polypropylene, polycarbonate, acrylonitrile butadiene styrene or polyamide or any other suitable polymeric material known to one of ordinary skill in the art. Further, such base tie 30 and wall tie 90 can be manufactured using molds with an injection molding process, or any other suitable manufacturing method, such as mold casting or machining, as known in the art.

First referring to the base tie 30, such a base tie can include an upper side 32, a bottom side 33, a front side 34, a back side 35, a left side 36 and a right side 37, the upper side 32 configured to face upward and the bottom side 33 configured to be positioned, face down, against a top surface of a concrete footing 10 (FIG. 1). The base tie 30 can include a first end portion 50 and a second end portion 52 with an intermediate portion 40 extending therebetween. In one embodiment, the first end portion 50 and the second end portion 52 can each be an extension of the intermediate portion 40, on opposite sides thereof, along a longitudinal length of the base tie 30. Furthermore, the intermediate portion 40 can be a generally elongated portion in comparison to the first end portion 50 and the second end portion 52. The intermediate portion 40 can also include rails 42 extending upward at the upper side 32 of the intermediate portion 40 to, thereby, define a recess 44 in the upper side 32 of the intermediate portion 40. The rails 42 can extend longitudinally along the length of the upper side 32 of the intermediate portion 40, of which the rails can define the front side 34 and back side 35 of the intermediate portion 40. The bottom side 33 of the base tie 30 is preferably substantially planar or flat since, as previously set forth, the bottom side 33 is sized and configured to be secured to the top surface of the concrete footing.

The recess 44 defined in the upper side 32 of the intermediate portion 40 can include various openings, including a center hole 46, extending through the upper side 32 to the bottom side 33 of the intermediate portion 40. The center hole 46 can be sized and configured to secure the base tie 30 to the concrete footing 10 (FIG. 1). The other openings can be utilized for minimizing the material required while maintaining structural integrity in the base tie as well as for other purposes set forth more fully herein. In one embodiment, the intermediate portion 40 also can include a bulge 48, defined in part by the rails 42, at a central portion thereof sized and configured to maintain the structural integrity of the base tie 40 as well as allow for a hammer head to nail a concrete nail through center hole 46 to minimize potentially hitting the rails while hamming such concrete nail. As such, the bulge 48 is sized and configured larger than the typical hitting surface of a hammer head.

Figure 2A:
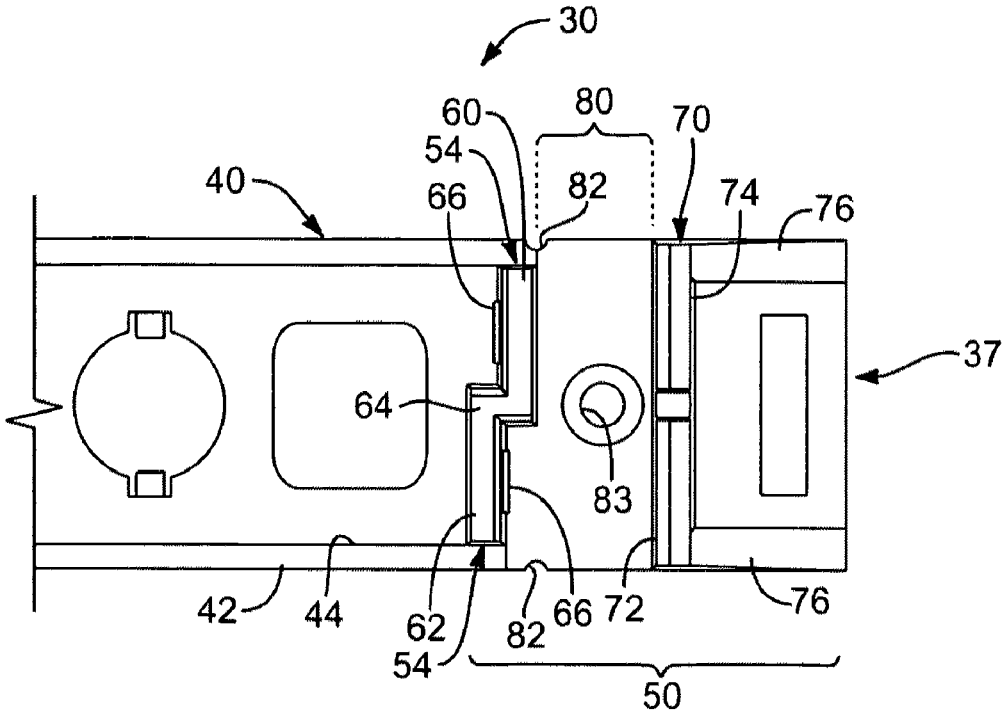
FIG. 2A is a top view of a first end portion of the base tie, according to the present invention.

Referring now to FIGS. 2 and 2A, as previously set forth, the first end portion 50 and the second end portion 52 can extend from the intermediate portion 40 of the base tie 30. The first end portion 50 can be substantially identical or similar to the second end portion 52. In particular, such end portions can each include an attachment portion 54 and a support wall 70. The attachment portion 54 and support wall 70 both extend upward at the upper side 32 of the base tie 30 and define a channel 80 therebetween. Each attachment portion 54 can include a first attachment portion 60 and a second attachment portion 62 that extend upward and laterally between the front side 34 and back side 35 of the base tie 30. The first attachment portion 60 can be closer to the end or right side 37 of the base tie 30 than the second attachment portion 62. Likewise, the first attachment portion 60 on the left side 36 of the base tie 30 can be closer to the left side 36 than the second attachment portion 62. Further, the attachment portion 54 can be unitary in structure with a mid portion 64 interconnecting the first attachment portion 60 and the second attachment portion 62, of which the mid portion 64 extends longitudinally with the base tie 30. As such, the first attachment portion 60 and the second attachment portion 62 extend laterally across each of the first and second end portions 50 and 52 in an offset manner with the mid portion 64 extending longitudinally therebetween.

In addition, each attachment portion 54 can include one or more protrusions 66 sized and configured to lock or attach to the wall tie 90. In one embodiment, the attachment portion 54 on the right side 37 can include a protrusion 66 on the inner surface of the first attachment portion 60 and a protrusion 66 on the outer surface of the second attachment portion 62. Likewise, on the left side 36 of the base tie 30, the first attachment portion 54 can include a protrusion 66 on the inner surface and a protrusion 66 on the second attachment portion 62 on the outer surface of the attachment portion 54. Such protrusions 66 on the attachment portion 54 are sized and configured to interconnect and removably lock with the wall tie 90, of which further explanation will be provided for the interconnection hereafter.

Each of the first end portion 50 and the second end portion 52 can also include a support wall 70. The support wall 70 can include an inner surface 72 and an outer surface 74, extending upward and between the front side 34 and back side 35 of the base tie 30. The support wall 70 can include additional supports 76 extending from the outer surface 74 of the support wall to provide additional structural integrity to the support wall. Such additional supports can extend, for example, from an intermediate height of the outer surface 74 of the support wall 70, angling downward toward a corresponding end of the first end portion 50 and the second end portion 52. Further, the additional supports 76 can define a portion of the front side 34 and back side 35 of each of the respective first and second end portions 50 and 52 of the base tie 30. As previously set forth, the upward extension of the both the support wall 70 and the attachment portion 54 define a channel 80 in each of the first end portion 50 and the second end portion 52. Such a channel 80 extends (laterally to the longitudinal length of the base tie 30) between the front side 34 and back side 35 of the base tie 30 at each of the first end portion 50 and the second end portion 52. Further, the channel 80 is sized and configured to receive and support a panel structure 150 (FIG. 1), such as plywood or Form ply, as previously set forth. Furthermore, the support wall 70 can define a channel slot 81, extending through the support wall 70, sized and configured to receive a fastener therethrough. In other words, such channel slot 81 can be configured to facilitate fastening the panel structure within the channel 80 and, thus, to the base tie 30.

Now with reference to the wall tie 90 of the tie system 20, the wall tie 90 includes an upper side 92, bottom side 93, a front side 94, a back side 95, a right side 96 and a left side 97. Further, such a wall tie 90 can include a first elongated wall portion 100 and a second elongated wall portion 102 with a cross-member 110 extending therebetween. The first elongated wall portion 100 includes an outer surface 104 and an inner surface 105, the outer surface 104 defining, at least in part, the right side 96 of the wall tie 90. Likewise, the second elongated wall portion 102 includes an outer surface 106 and an inner surface 107 with the outer surface 106 defining, at least in part, the left side 97 of the wall tie 90. The outer surfaces of the first and second elongated wall portions 100 and 102 can be substantially flat and sized and configured to be positioned against and secured to the panel structure 150, the panel structure also being positioned in the channel 80 of the base tie 30, as previously set forth.

Furthermore, the first and second elongated wall portions 100 and 102 include an intermediate wall portion 108 with an inner surface that can be raised. Such raised surface can be thicker than the remaining portions of both the first and second elongated wall portions 100 and 102. Further, such intermediate wall portion 108 is sized and configured to be secured to the panel structures with fasteners and is, therefore, configured to be thicker to increase the structural integrity for such attachment. In addition, the intermediate wall portion 108 for each of the first and second elongated wall portions 100 and 102 can include and define holes 109 extending between the front side 94 and back side 95 of the wall tie 90. Such holes 109 defined in each intermediate wall portion 108 of the wall tie 90 limits the amount of material necessary for the structural integrity of the wall tie while also adding structural thickness for being secured to the panel structures.

As previously set forth, the first and second elongated wall portions 100 and 102 are interconnected by a cross-member 110. The cross-member 110 can extend from respective inner surfaces of the first and second elongated wall portions 100 and 102 at one or more locations. In particular, the cross-member 110 can include upper beams 112, a mid beam 114 and a lower beam 116 with multiple struts 118 interconnecting such upper, mid and lower beams. The upper beams, mid beam and lower beam can extend from respective upper, mid and lower portions of the inner surface of the intermediate wall portion 108 of both the first and second elongated wall portions 100 and 102. According to this arrangement, the cross-member 110, including the multiple beams and struts, are sized and configured to provide the structural integrity necessary to withstand the concrete loads placed thereon.

Furthermore, the cross-member 110 can include multiple rebar holders. In particular, the cross-member 110 can include a center rebar holder 120 with a right rebar holder 122 and a left rebar holder 124 positioned above the center rebar holder 120. The center rebar holder 120 is defined at a juncture between the upper beams 112 of the cross-member 110 with a u-shaped configuration. The upper beams can include cross-member extensions 126, extending upward, to define each of the center, right and left rebar holders 120, 122 and 124 each having a u-shaped configuration. Of course, such rebar holders can include other configurations with means for maintaining rebar. With such an arrangement, rebar can be readily placed within one or more of the u-shaped configurations for substantially exact rebar placement and positioned in a time efficient manner. Each of the center rebar holder 120 and right and left rebar holders 122 and 124 can be configured with structure to attach and hold the rebar, with an interference type fit, in position or can be configured to allow the rebar to rest within the various u-shaped configurations.

In addition, the center rebar holder 120 can be sized and configured to receive both ½" diameter and ⅝" diameter rebar, the ½" diameter rebar held in a lower portion of the center rebar holder and the ⅝" diameter rebar held in an upper portion with a ridge 121 defined therebetween. That is, the ridge 121 defines an upper edge of the lower portion sized for the ½" diameter rebar and the ridge 121 defines a lower edge of the upper portion sized for the ⅝" diameter rebar. Further, the center rebar holder 122 can include a rebar groove 123 defined at a bottom of the center rebar holder 122. Such rebar groove 123 is sized and configured to receive a raised seam on the periphery of rebar and, in this case, the ½" diameter rebar. The right and left rebar holders 122 and 124 are sized and configured to receive ½" diameter rebar therein each including a rebar groove defined therein.

According to an important aspect of the present invention, each of the first and second elongated wall portions 100 and 102 can include a lower attachment portion 130 and an upper attachment portion 140. The lower attachment portion 130 of the wall tie 90, located at a lower portion of each of the first and second elongated wall portions 100 and 102, can be sized and configured to attach and interconnect or interlock (in a removable manner) to the attachment portion 54 of a respective and corresponding first and second end portion 50 and 52 of the base tie 30. The upper attachment portion 140 of each of the first and second elongated wall portions 100 and 102 can be sized and configured to substantially mimic the attachment portion 54 of the base tie 30 so that additional wall ties 30 can be stacked vertically upon each other to, thereby, build the wall ties 30 to the approximate desired height for the concrete wall form.

Figure 2B:
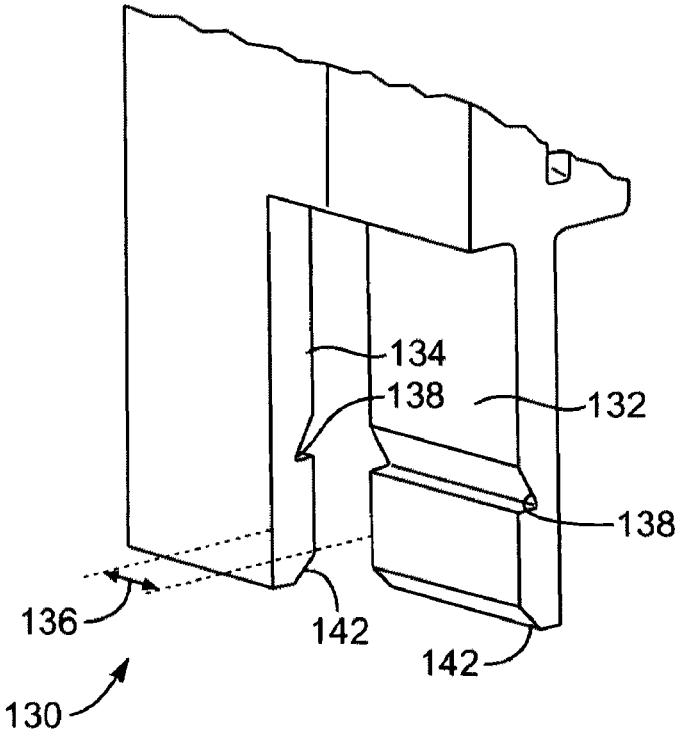
FIG. 2B is a perspective view, from a right rearward side of a lower attachment portion of the wall tie depicted in FIG. 2, according to the present invention.

With respect to FIGS. 2 and 2B, there is disclosed the lower attachment portion 130 of the wall tie 90. Each lower attachment portion 130, extending from the first and second elongated wall portions 100 and 102, can include a first lower attachment portion 132 and a second lower attachment portion 134. The first and second lower attachment portions 132 and 134 can be configured to extend downward from the respective elongated wall portion and define a gap 136 therebetween. Further, the first lower attachment portion 132 can be laterally offset with respect to the second lower attachment portion 134 sized and configured to correspond with the offset arrangement of the attachment portion 54 of the base tie 30 (See also, FIG. 2A). Further, the first lower attachment portion 132 for both the first and second elongated wall portions 100 and 102 can include a groove 138 that extends laterally within the outer surface of the first lower attachment portion 132. Similarly, the second lower attachment portion 134 for both the first and second elongated wall portions 100 and 102 also can include a groove 138 that extends laterally within the inner surface of the second lower attachment portion 134. In addition, each of the first and second lower attachment portions 132 and 134 can include a tapered free end 142 so as to allow ready insertion and attachment of the wall tie 90 to the base tie 30.

Figure 3:
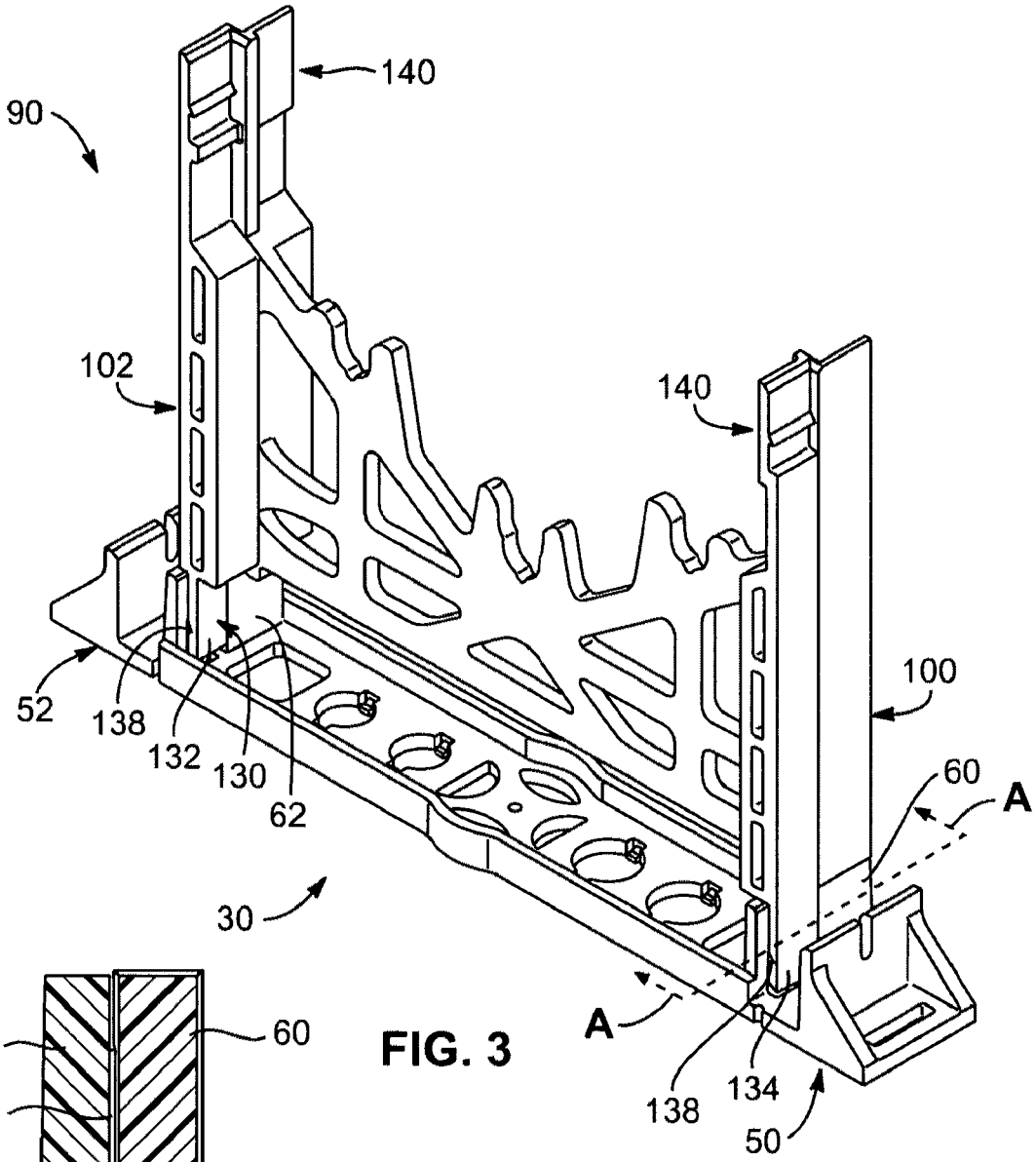
FIG. 3 is a perspective view of an assembled base tie and wall tie, according to the present invention.
Figure 3A:
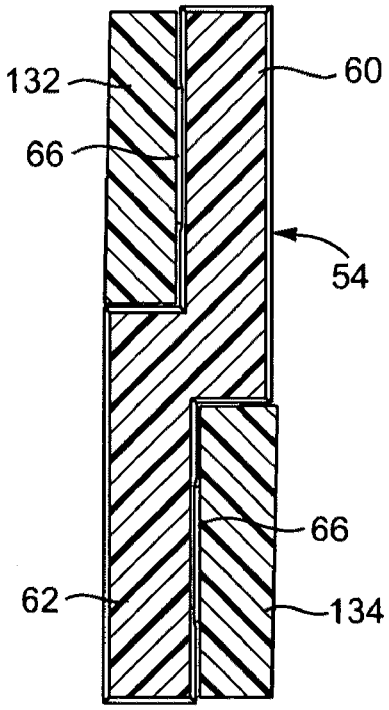
FIG. 3A is a cross-sectional view, taken along line A, of an interconnection between the base tie and the wall tie, according to the present invention.

With reference now to FIGS. 3 and 3A, there is illustrated the wall tie 90 assembled with the base tie 30. More particularly, the first and second lower attachment portion 132 and 134 of each first and second elongated wall portions 100 and 102 are sized and configured to mate and interconnect with a respective one of each of the first and second attachment portions 60 and 62 of each first and second end portion 50 and 52 of the base tie 30. Further, the groove 138 within the first and second lower attachment portion 132 and 134 is sized and configured to mate and interconnect with the protrusion 66 of the first and second attachment portion 60 and 62 of the base tie 30 to, thereby, provide a locking arrangement. In this manner, the offset and gaped arrangement between the first and second lower attachment portions 132 and 134 of the wall tie 90 readily interconnects and attaches to the offset and unitary arrangement of the attachment portion 54 (having a respective first and second attachment portion 60 and 62) of the base tie 30. As such, the wall tie 90 is configured to attach and interconnect with the base tie 30. Further, as previously set forth, the wall tie 90 includes an upper attachment portion 140 that mimics the structure of the attachment portions 54 of the base tie 30. As such, the lower attachment portions 130 of a second wall tie 90 can attach and interconnect with the upper attachment portion 140 of a lower wall tie 90 therebelow to, thereby, facilitate vertically building a stack of wall ties 90 upon a single base tie 30 to the desired height of the concrete wall form (See FIG. 1).

Based on the foregoing, the tie system of the present invention is advantageous in comparison to the prior art concrete form systems due to the tie system comprising primarily two components, the base tie and the wall tie. Such two components in the tie system inherently provides advantages of being compact for shipping purposes, minimizing the risk of damaging the components during shipping and even while building the concrete forms. Further, due to the compact and light nature of the tie system with primarily two different components, installing the tie system to build the concrete forms is less laborious than prior art concrete form systems with minimized complexity. Moreover, the tie system of the present invention includes greater cost and time efficiency in regard to manufacturing, shipping and assembling such tie system.

Figure 4:
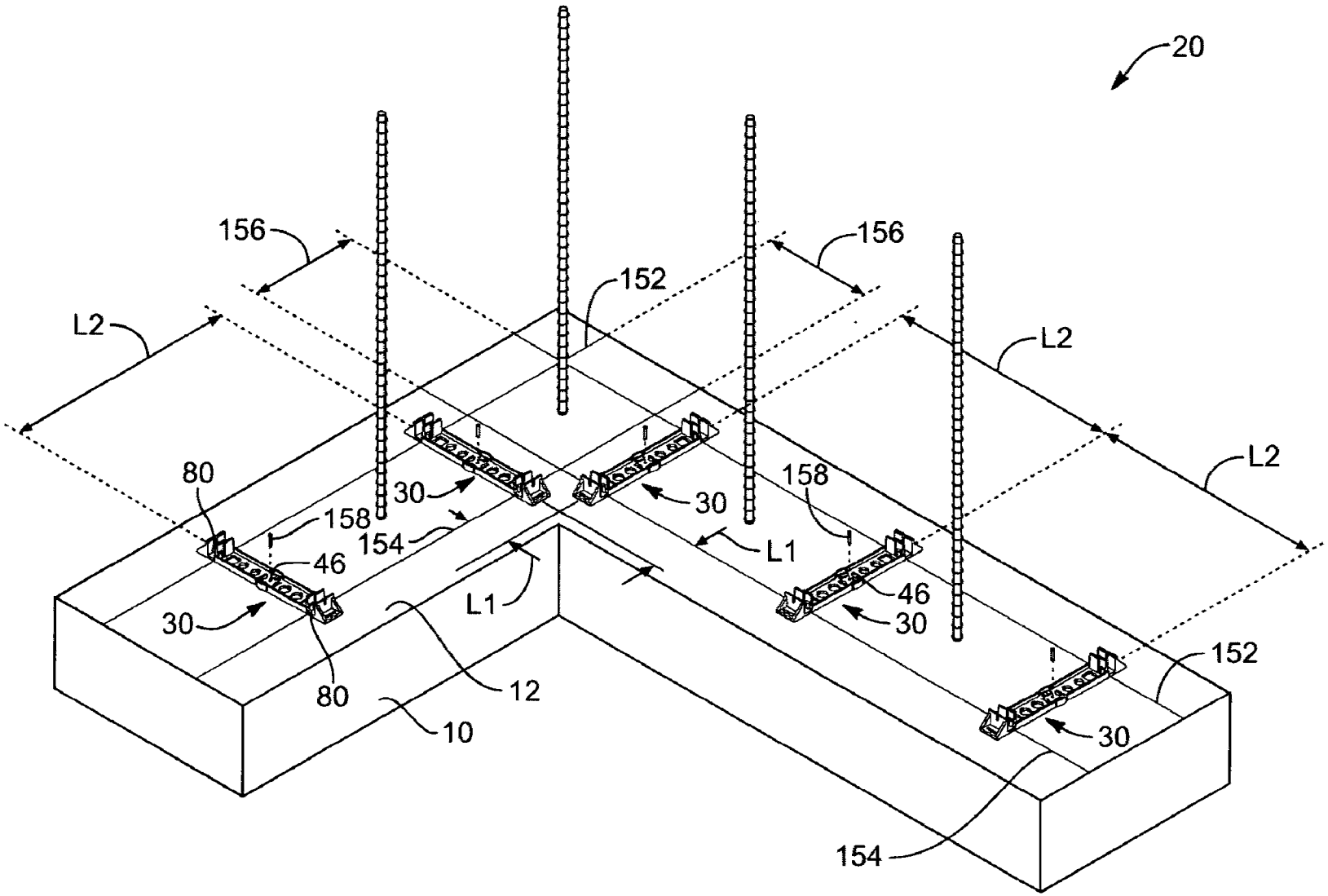
FIG. 4 is a perspective view of a typical concrete footing with base ties positioned thereon, according to one embodiment of the present invention.

With respect to FIGS. 4 through 14, the process and method for assembling the tie system to build concrete forms, according to an embodiment of the present invention, will now be described. Referring first to FIG. 4, there is disclosed a step for securing the base tie to a concrete footing 10 with a corner. The footing 10 can first be marked with a chalk line on a top surface 12 thereof, marking the position for an outside perimeter 152 and inside perimeter 154 of the concrete wall. Such marked chalk line should correspond with the desired concrete wall thickness 156. Likewise, the base ties and wall ties employed should correspond with the desired concrete wall thickness, sized, but not limited to, according to the most typical concrete wall thicknesses of about 8", 6" or 4" thick concrete walls. Once the chalk lines are marked, placement of the first base tie 30 can be measured a first length L1 from the inside corner chalk line for the concrete wall. Such first length L1 can be preferably about 3" from the inside corner chalk line. Placement of the other base ties 30 along the length of the footing 10, can be spaced a second length L2, separate and distinct from each other. The last base tie 30 along the length of the footing 10, whether at an end or a corner, can be measured the first length L1 (approximately 3") from such end or corner. The same procedure can be followed along the other length of footing 10 from the inside corner chalk line, as depicted.

The second length L2 in which the base ties 30 are spaced can vary upon parameters, namely (but not limited to), the thickness of the panel structure and the height of the concrete wall. The thickness of a panel structure that can be employed with the present invention can include, but is not limited to, 7/16", ½", 9/16", ⅝", 11/16", ¾", 1", or 1⅛" thickness. When using typical plywood, the preferred parameters are as follows: For a one to two foot concrete wall height utilizing a plywood thickness between 7/16" to 1⅛" thick, the spacing for the second length L2 is preferably a maximum of about twenty-four inches. If the wall height is 2½" feet, the spacing for the second length L2 is a maximum of about nineteen inches utilizing plywood at 7/16" or ½" thick and a maximum of about twenty-four inch spacing for plywood 9/16" through 1⅛" thick. Further, if the wall height is three feet, the spacing for the second length L2 is a maximum of about sixteen inches with a 7/16" or ½" thick plywood and a maximum of about twenty-four inch spacing for 9/16" through 1⅛" thick plywood. If the wall height is 3½" feet, the spacing for the second length L2 is a maximum of about twelve inches utilizing plywood at 7/16" or ½" thick, and a maximum of about a 19 inch spacing for plywood at 9/16" or ⅝" thick, and about a maximum of about twenty-four inch spacing using plywood at 11/16" through 1⅛" thick. For a wall height of four feet, the spacing for the second length L2 can be a maximum of about sixteen inches with 9/16" or ⅝" thick plywood and a maximum of about twenty-four inch spacing using 11/16" through 1⅛" thick plywood. Further, it should be noted that it is preferred to utilize typical plywood having a thickness greater than ½" for a wall height of four feet. Again, as set forth, the above-indicated parameters relate to the panel structure being typical plywood. When using Form ply, it is preferred to utilize ½" thick panels for any wall height up to ten feet. The preferred panel structures employed that are rated as Form ply are typically high density overlay ("HDO") plywood or medium density overlay ("HDO") plywood. Other suitable panel structures, as known to one of ordinary skill in the art, can also be employed with the tie system of the present invention.

For accurate placement and alignment, the base tie 30 can include a notch 82 at the inside edge of each channel (See FIG. 2A). Such notch 82 is configured to be aligned and correspond with the inside perimeter 152 and outside perimeter 154 chalk lines marked on the footing 10. Once the base ties 30 are placed with their respective notches 82 aligned with the chalk lines and at the correct spacing as set forth above, such base ties 30 should be secured to the footing preferably with a 1½" concrete nail 158. Such nail 158 can be nailed through the center hole 46 in the base ties 30. If desired, additional concrete nails can be run through other portions, preferably within an interior portion, of the base tie 30 to ensure securing the base tie to the footing 10 while also making sure the notches remain aligned with the chalk lines with the base tie extending perpendicular to the chalk lines.

Figure 5:
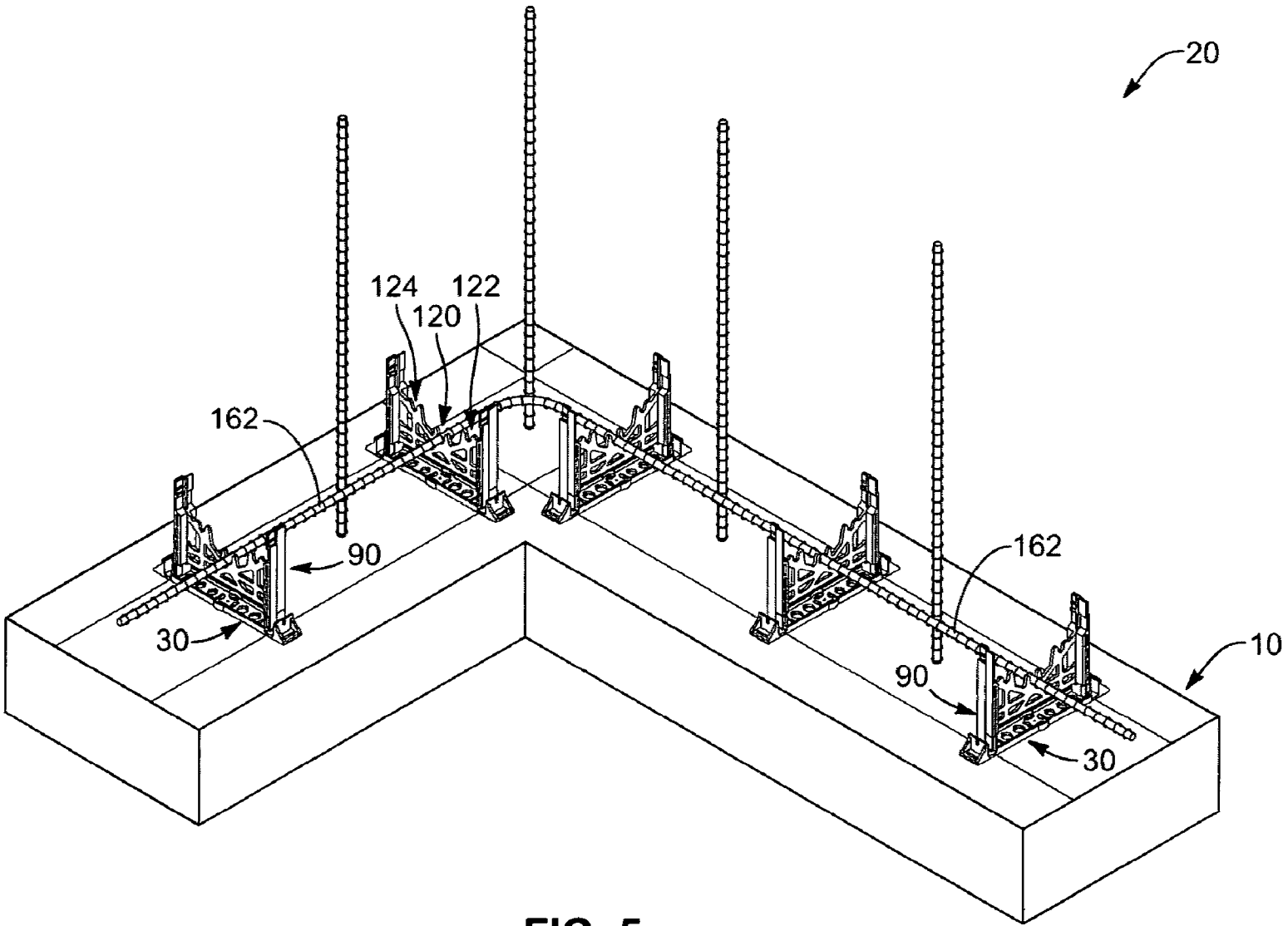
FIG. 5 is a perspective view of the footing with a first course of wall ties attached to base ties on the footing with horizontal rebar positioned over the wall ties, according to the present invention.
Figure 6:
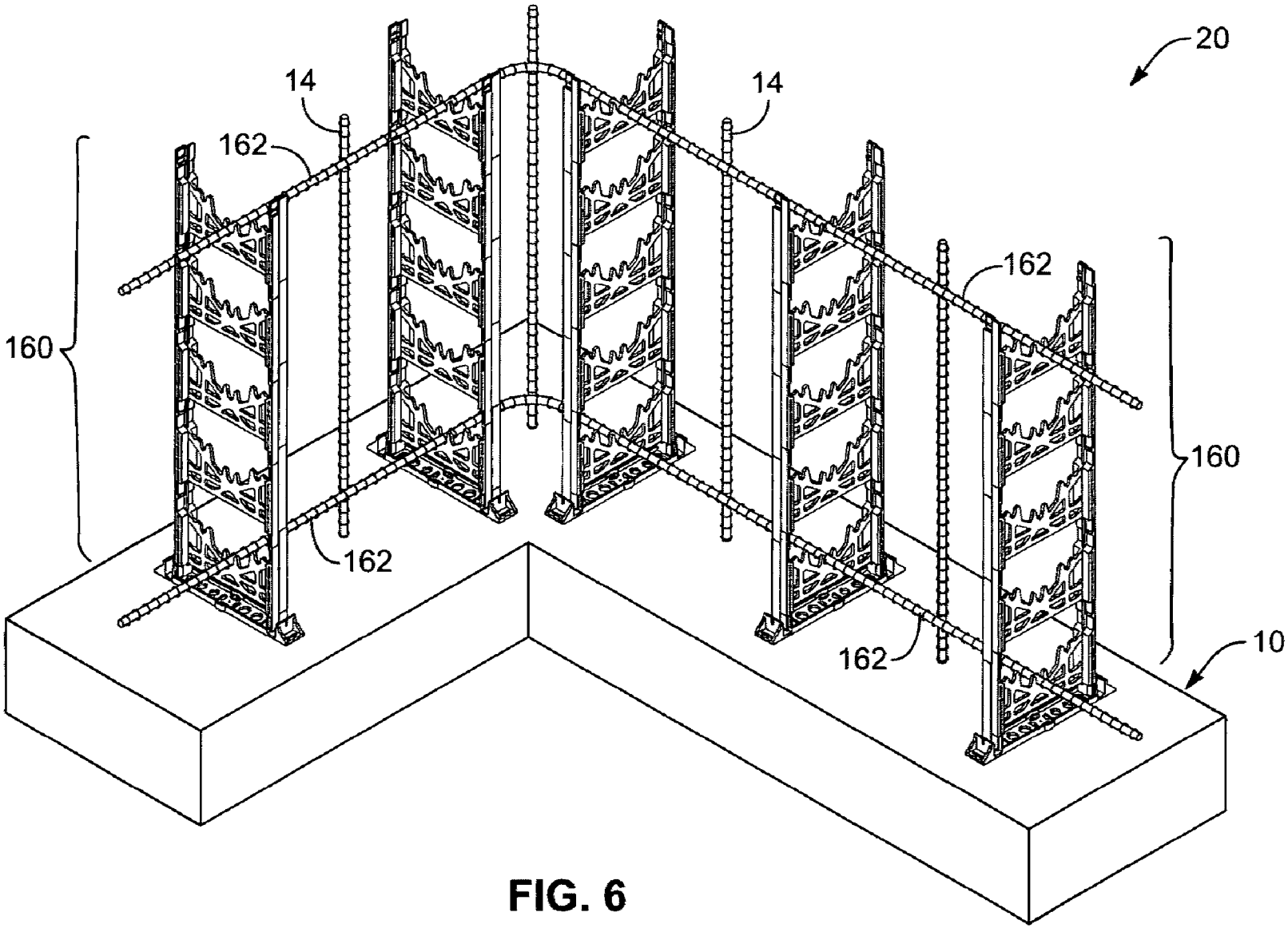
FIG. 6 is a perspective view of the footing with multiple tie stacks and horizontal rebar therewith, according to an embodiment of the present invention.

With reference to FIGS. 5 and 6, there is disclosed a step for building tie stacks 160 of the tie system 20 on the concrete footing 10 with horizontal rebar 162, according to the present invention. In particular, once the base ties 30 are properly secured, a first course of wall ties 90 can be attached to the base ties 30. Such attachment is readily employed by mating the lower attachment portions 130 of a given wall tie 90 with the attachment portion 54 of the base tie 30, as previously set forth herein (See FIGS. 2 and 3). After attachment of the first course of wall ties 90 is complete, it is necessary to determine the desired height for horizontal rebar 162 placement. Typically, it is advantageous and required by code to run a lower level of horizontal rebar 162. As such, once the first course of wall ties 90 are placed, horizontal rebar 162 can be run by placing the rebar within the center rebar holder 120. Each of the rebar holders are sized and configured to maintain the rebar, with accurate positioning and with an interference fit. At the center rebar holder 120 level, the horizontal rebar will be approximately 2¾" above the footing. If a slightly different height is required, rebar can be placed along the right or left rebar holders 122 and 124 in each wall tie 90 or rebar can be tied off at different heights along the various portions of the wall tie or tied to the vertical rebar 14. If the design requirements call for two horizontal rebar, such rebar can be positioned in both the right and left rebar holders 122 and 124.

Once the horizontal rebar 162 is positioned along the first course of wall ties, additional wall ties can be added to each stack to the height necessary for running another length of horizontal rebar 162. In other words, depending on the required vertical spacing of the horizontal rebar, the appropriate number of wall ties 90 can be pre-assembled to achieve the desired vertical spacing of such horizontal rebar 162. For example, each wall tie 90 can represent about six inches of vertical height. If your intended rebar spacing between horizontal rebar is twenty-four inches apart, then pre-assemble four wall ties and attached such pre-assembled wall ties to each tie stack before-running a second length of horizontal rebar 162. Once such rebar is positioned as desired, additional wall ties 90 can be stacked vertically for each tie stack to the desired height. It should be noted that tie stacks are complete within about five inches of the intended height of the concrete wall. For example, for an intended wall height of three feet, a total of five wall ties will make a complete tie stack 160 with the base tie 30 at the bottom (representing about one inch) providing about five inches below the intended wall height of three feet. As will be readily understood by one of ordinary skill in the art, the ability to internally build the tie stacks 160 with the horizontal rebar 162 prior to positioning the panel structures thereto, as set forth above, provides for quick and ready assembly of the tie system 20, and therefore provides advantages over the prior art in reducing complexity to, thereby, be more time and cost efficient.

Figure 7:
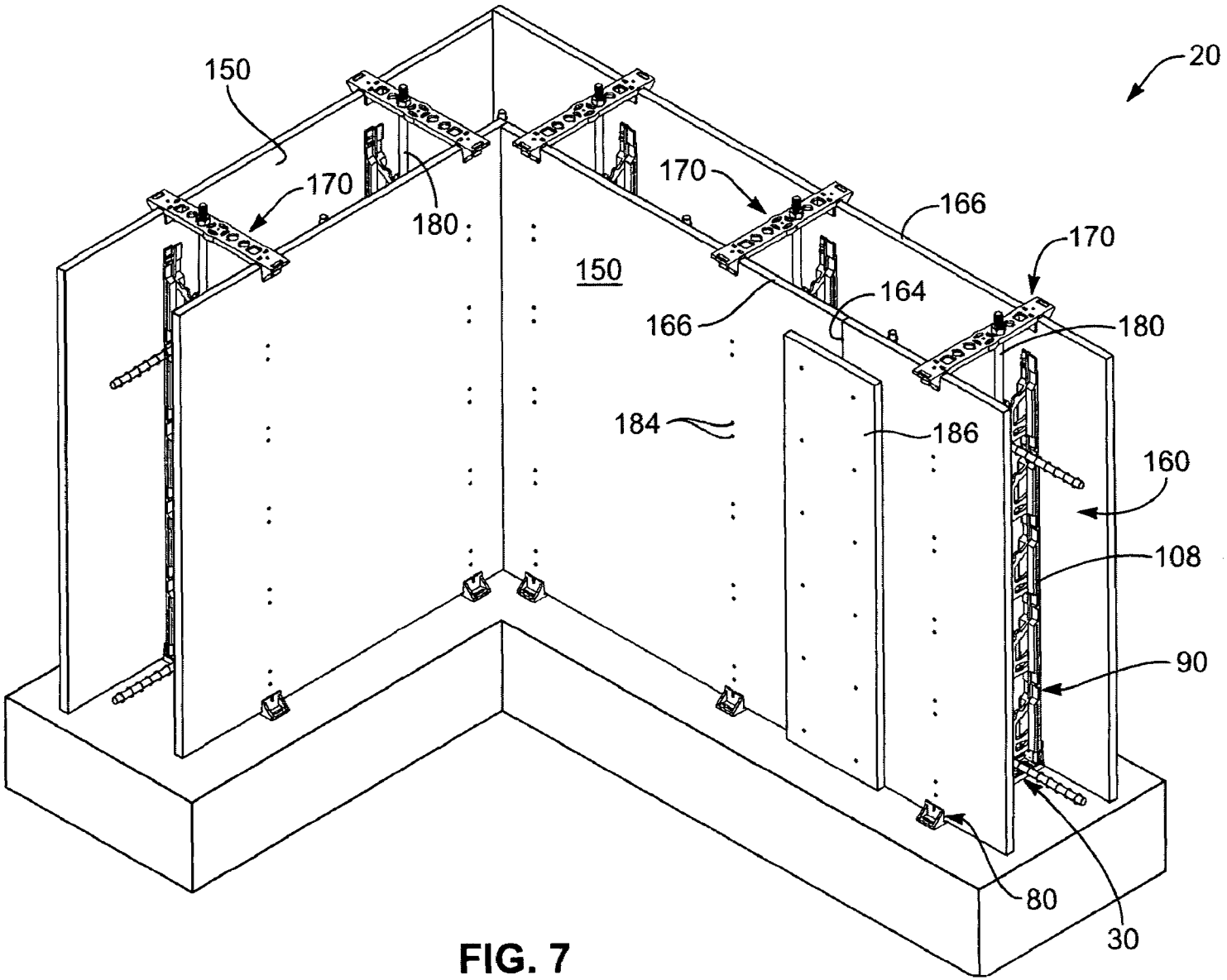
FIG. 7 is a perspective view of the footing with panel structures secured to the wall tie stacks and positioned between base ties and a finish ties, according to an embodiment of the present invention.

Referring now to FIG. 7, there is disclosed a step for attaching the panel structures 150 of the tie system 20 with a finish tie 170, according to the present invention. In particular, panel structures 150 can now be placed within the channel 80 on each side of the base ties 30 so that the panel structures run parallel to each other with each tie stack 160 substantially oriented perpendicular to the panel structures 150, as illustrated. As previously set forth, to ensure optimal concrete walls, i.e., plum and straight, it is important that the thickness and the type of panel structures 150 correspond with the intended wall height and the spacing of the tie stacks, as previously set forth. Further, it is necessary to make sure the seams 164 or butt joints between the plywood panel structures 150 do not correspond with the tie stacks 160. Once such panel structures 150 are placed, base ties can be inverted and placed over a top portion 166 of the panel structures 150 with such top portion 166 positioned and received within the channels of each inverted base tie. The inverted base tie is referred to herein, according to one embodiment, as a finish tie 170. Such finish tie 170 can be configured to interconnect directly to the panel structure 150.

Figure 8:
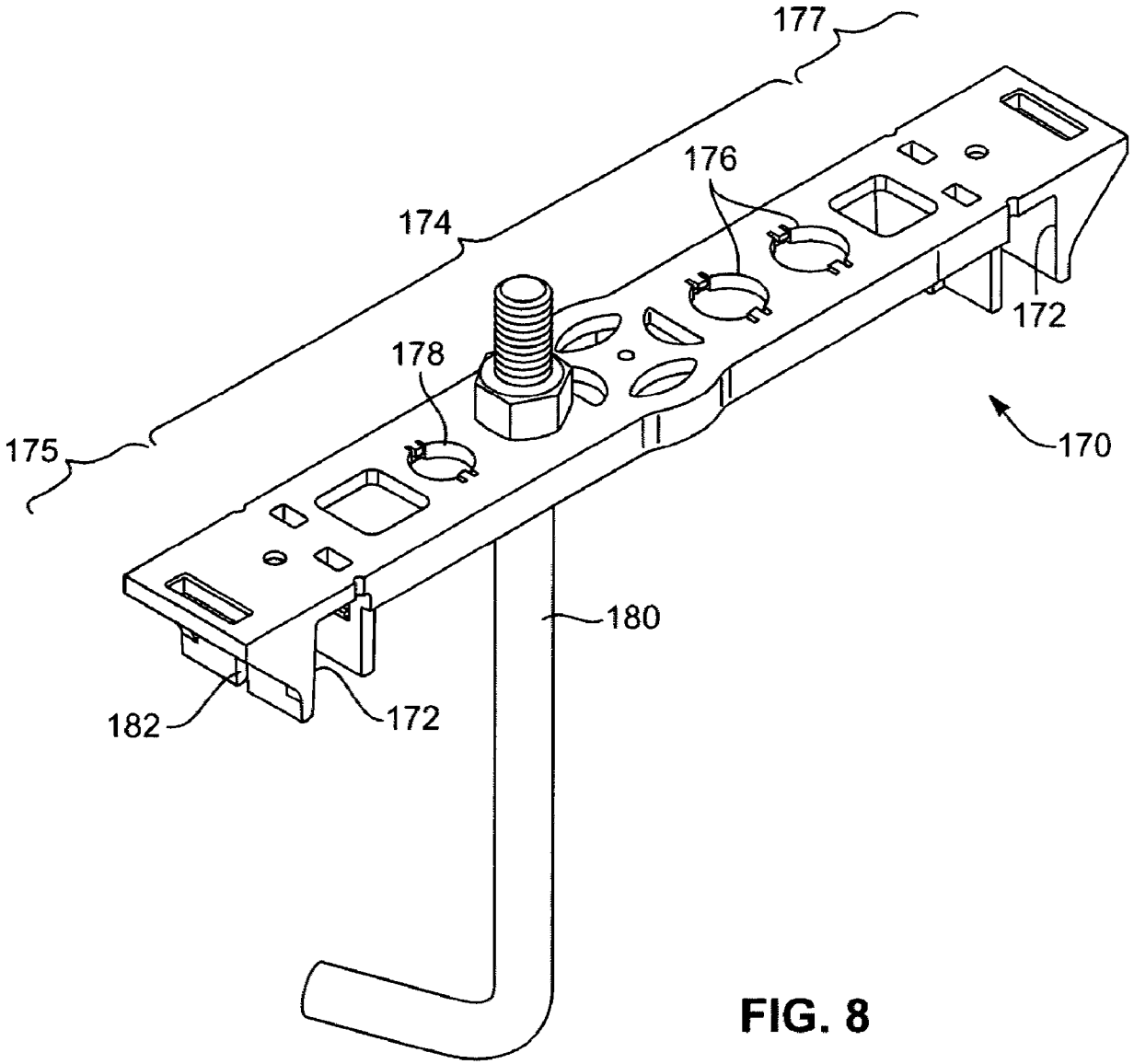
FIG. 8 is a perspective view of the top tie with a anchor bolt coupled thereto, according to one embodiment of the present invention.

With reference to FIGS. 7 and 8, the finish tie 170 includes various sized holes extending through the intermediate portion 174 of such finish tie 170. In particular, there is a pair of ⅝" diameter holes 176 and a pair of ½" diameter holes 178. These holes can be configured to receive and hold an anchor bolt 180. As shown, the anchor bolt 180 can be positioned within one of the holes and secured for subsequent anchoring structure to the top surface of the concrete wall (not shown). For concrete walls having a thickness of 8", the outer holes are center line placement for 2×4 plates and the inner holes are center line placement for 2×6 plates. As such, employing the anchor bolt 180 with the finish tie 170 will provide substantially perfect placement of the anchor bolts 180.

Like the base tie 30, the finish tie 170 can include a first end portion 175 and a second end portion 177 with the intermediate portion 174 extending therebetween. Each of the end portions can define channels 172 therein sized and configured to be positioned over and receive the panel structures 150. Further, channel slots 182 defined in each of the end portions can be employed to fasten the finish tie 170 to the panel structures 150. It should be noted that it is not required to fasten the finish tie 170 to the panel structures 150.

Once the panel structures 150 are positioned within the channels 80 of the base ties 30 and further, the channels 172 of the finish ties 170 are also positioned over the panel structures 150, fasteners 184, such as screws, can be inserted through the panel structures 150 and through the wall ties 90. Placement of such fasteners should correspond with the first and second elongated wall portions 100 and 102 of each wall tie 90 and, more specifically, the intermediate wall portion 108 (See FIG. 2) where the wall tie 90 is thicker than other portions of the wall tie. For more accurate and efficient screw placement, it is preferred to make a template or tool to mark the position for placing screws in the plywood panel structure 150. As depicted in FIG. 7, it is preferred to place two screws through the panel structure 150 and within each side or intermediate wall portion 108 of the wall tie 90. In addition, at the seams 164 or butt joints of the plywood panel structure 150, additional reinforcement should be employed by fastening a scrap piece 186 of plywood over the seem 164 and securing such scrap piece 186 with two vertical rows of screws with about six inches on-center on each side of the seam 164.

FIGS. 9 through 13 disclose additional supporting structures that can be built around the form of the tie system 20 of the present invention. Such additional support structures can be built-up around seems, potential weak portions in the forms or portions that will receive greater loads to ensure the forms will maintain their structural integrity when loaded with the concrete. Further, it is preferred to employ additional supporting structure for any wall height and is required for wall heights three feet and higher.

Figure 9:
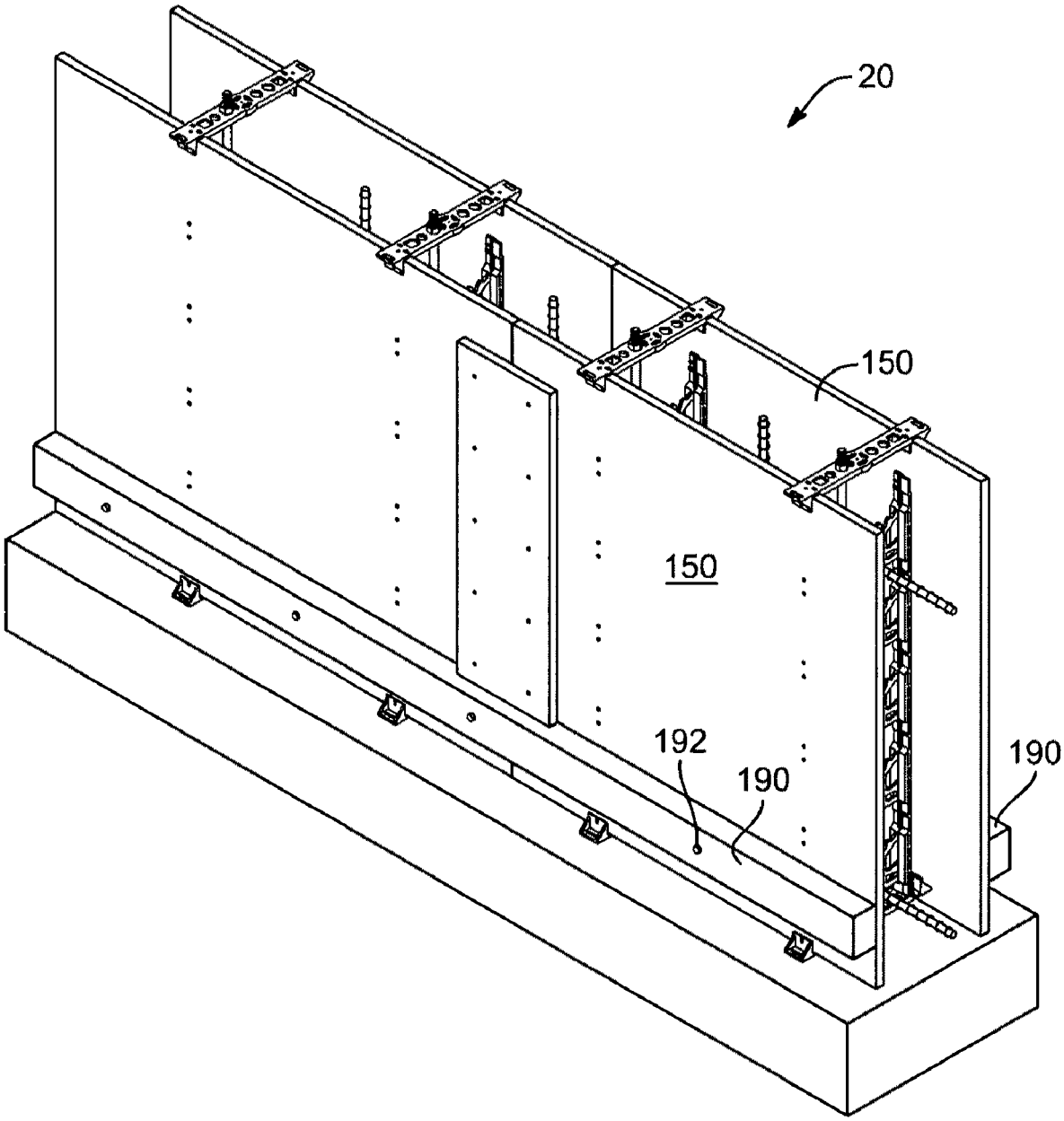
FIG. 9 is a perspective view of the tie system, depicting additional support structure for such system, according to an embodiment of the presents invention.
Figure 10:
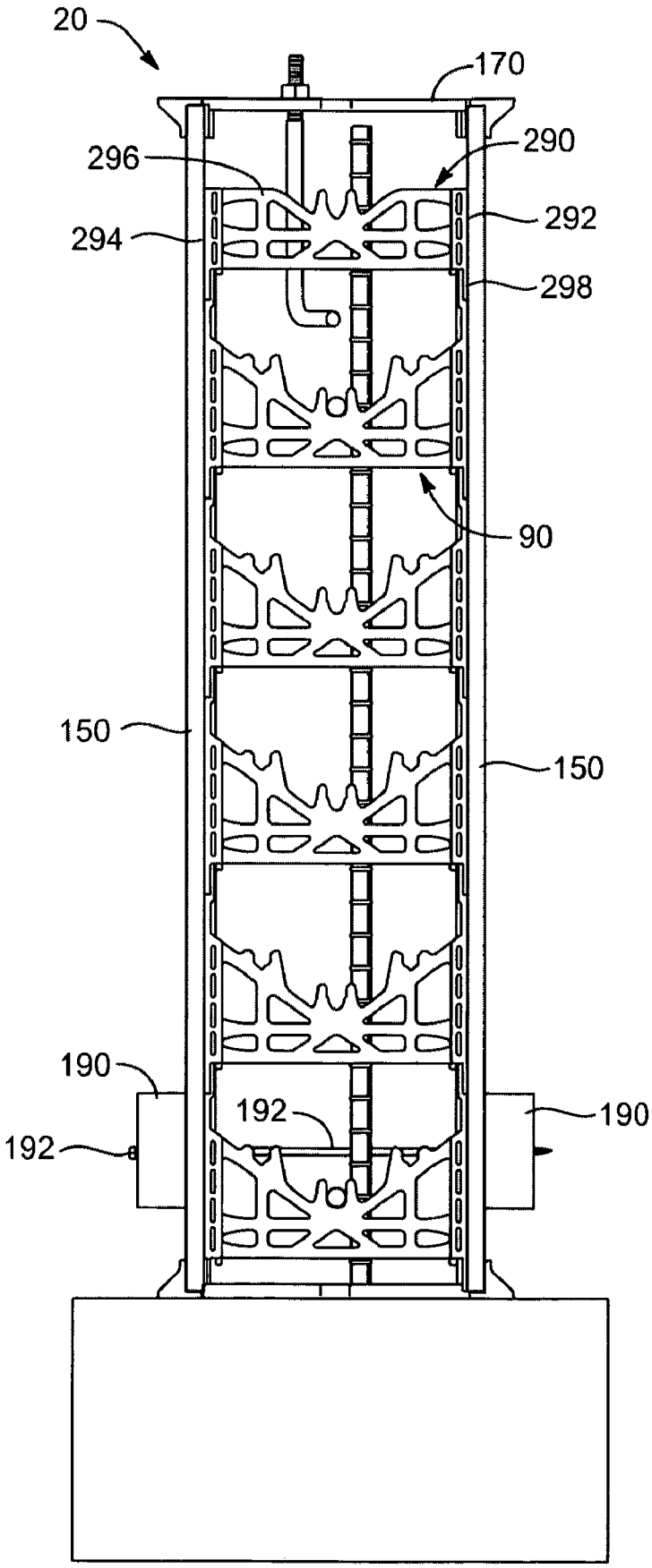
FIG. 10 is a side view of the additional support structure for the tie system depicted in FIG. 9, illustrating an additional top wall tie integrated with the tie system, according to another embodiment of the present invention.

Referring to FIGS. 9 and 10, there is disclosed a lag whaler arrangement in conjunction with the tie system 20 of the present invention. In particular, a 2×4 whaler 190 extends along a bottom portion of both sides of the panel structures 150 with, for example, several 5/16"×15" screws 192 extending laterally through both whalers 190. Such lag whaler arrangement provides additional support to the tie system 20 of the present invention where the forms receive the greatest load pressure, such as, while pouring the concrete with the use of a hydraulic pumping system, to ensure the width of the forms will remain substantially constant and stationary. Once the concrete is poured within the forms, it is important to remove the screws within one to three hours. Removing the lag whaler screws 192 after three hours can make such removal time consuming.

With reference to FIG. 10, there is disclosed additional supporting structure that is internal and integrated with the wall ties in the tie system 20 of the present invention. In particular, in one embodiment, the tie stack can include a top wall tie 290. Such top wall tie 290 is sized and configured to be positioned and attached to a lower wall tie 90 and is configured to be the highest tie that is directly interconnected to other ties in the tie stack in the tie system 20. The top wall tie 290 can include a similar profile as the wall tie 90, except the top wall tie 290 can extend approximately three to four inches in vertical height, rather than the six inches of the wall ties 90. As such, the top wall tie 290 can include a first elongated wall portion 292 and a second elongated wall portion 294 with a cross-member 296 extending therebetween. Further, the top wall tie 290 can include a lower attachment portion 298 at a lower end of each of the first elongated wall portion 292 and the second elongated wall portion 294. The lower attachment portion 298 of the top wall tie 290 is sized and configured to attach to the upper attachment portion 140 of the wall tie 90 (See FIG. 2). Such top wall tie 290 can provide internal support, in addition to the finish tie 170, to the tie system 20 at an upper portion of the panel structures 150. Similar to the wall ties, the top wall tie 290 is sized and configured to be disposed between the panel structures 150 and is configured to be fastened to and between the panel structures.

Figure 11:
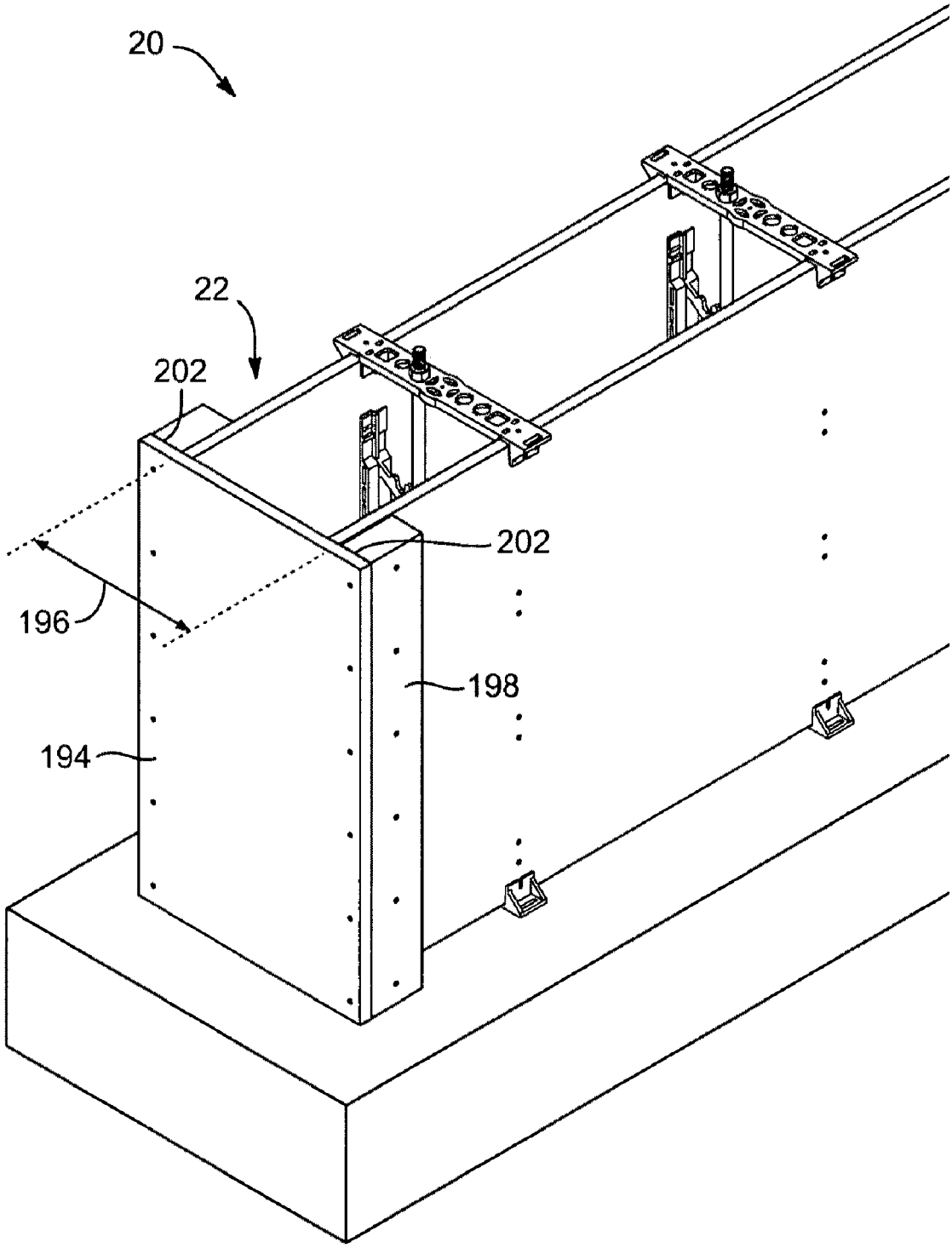
FIG. 11 is a perspective view of another embodiment of additional support structure for a wall end, according to the present invention.

FIG. 11 discloses an end portion 22 of the tie system 20, according to another aspect of the present invention. Additional supporting structure can be built for end portions 22 by simply having an end sheet 194 of plywood be cut wider, such as about three inches wider, than a width 196 of the parallel plywood panel structures 150 and securing two 2×4 beams 198 vertically to an inside edge 202 of the wider end sheet 194, as depicted.

Figure 12:
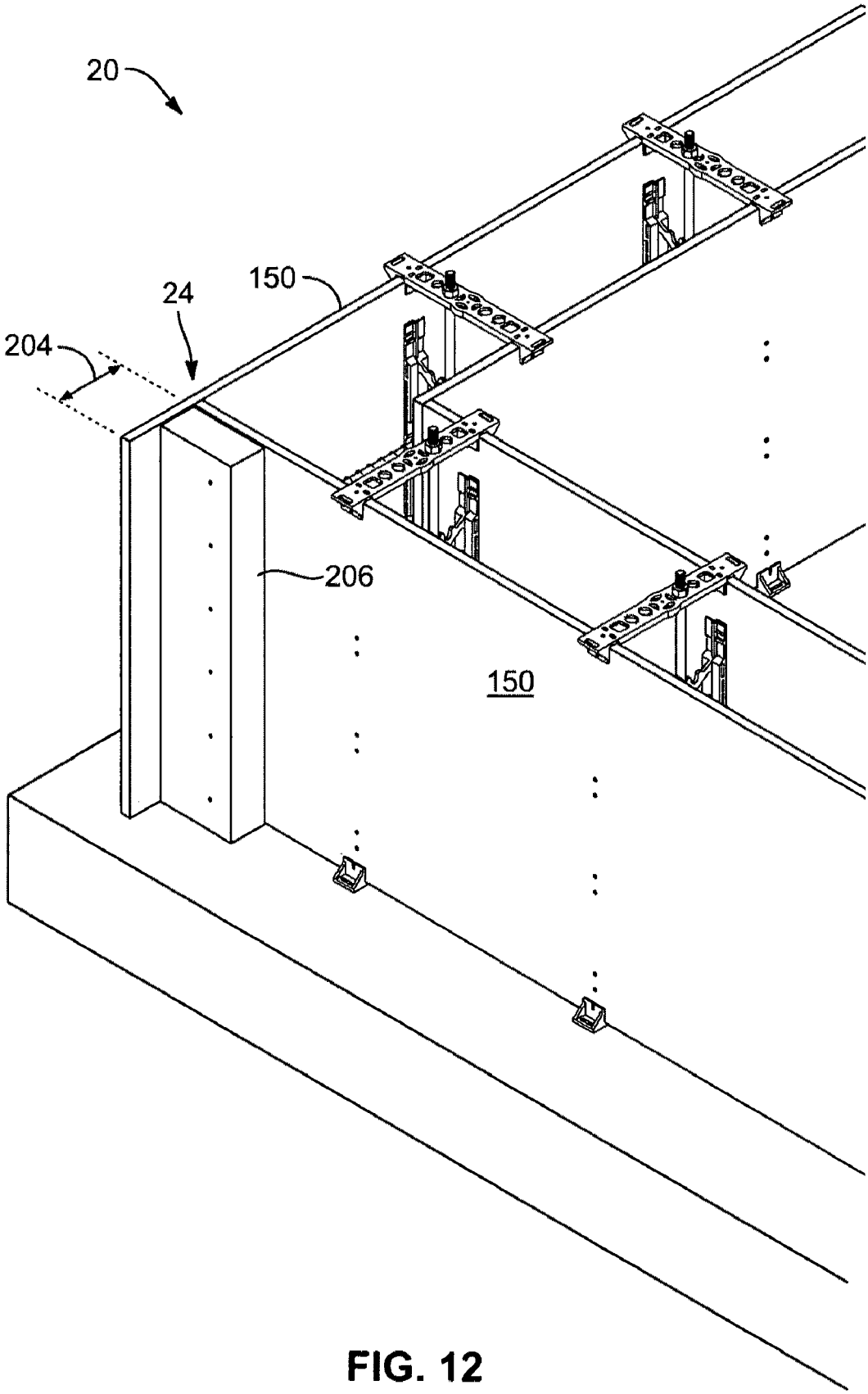
FIG. 12 is a perspective view of additional support structure for a wall corner, according to one embodiment of the present invention.

Referring now to FIG. 12, additional supporting structure can also be employed for outside corners 24 of the tie system 20, according to the present invention. In particular, for an outside corner 24, one of the panel structures can extend a longer length 204, such as about three inches, and then fasten a 2×4 beam 206 vertically to both intersection panel structures 150, as depicted. If one cannot extend the plywood panel structure 150 longer a given distance, the corner can be wrapped with two 2×4 beams 208 extending vertically, as depicted in the outside corner 24 of the tie system 20 in FIG. 13. For inside corners, no additional support is needed up to a three foot wall height. For inside corners taller than three feet, the outside corner detail can be inverted by fastening a 2×4 beam vertically to the two intersecting inside corner panels.

Figure 13:
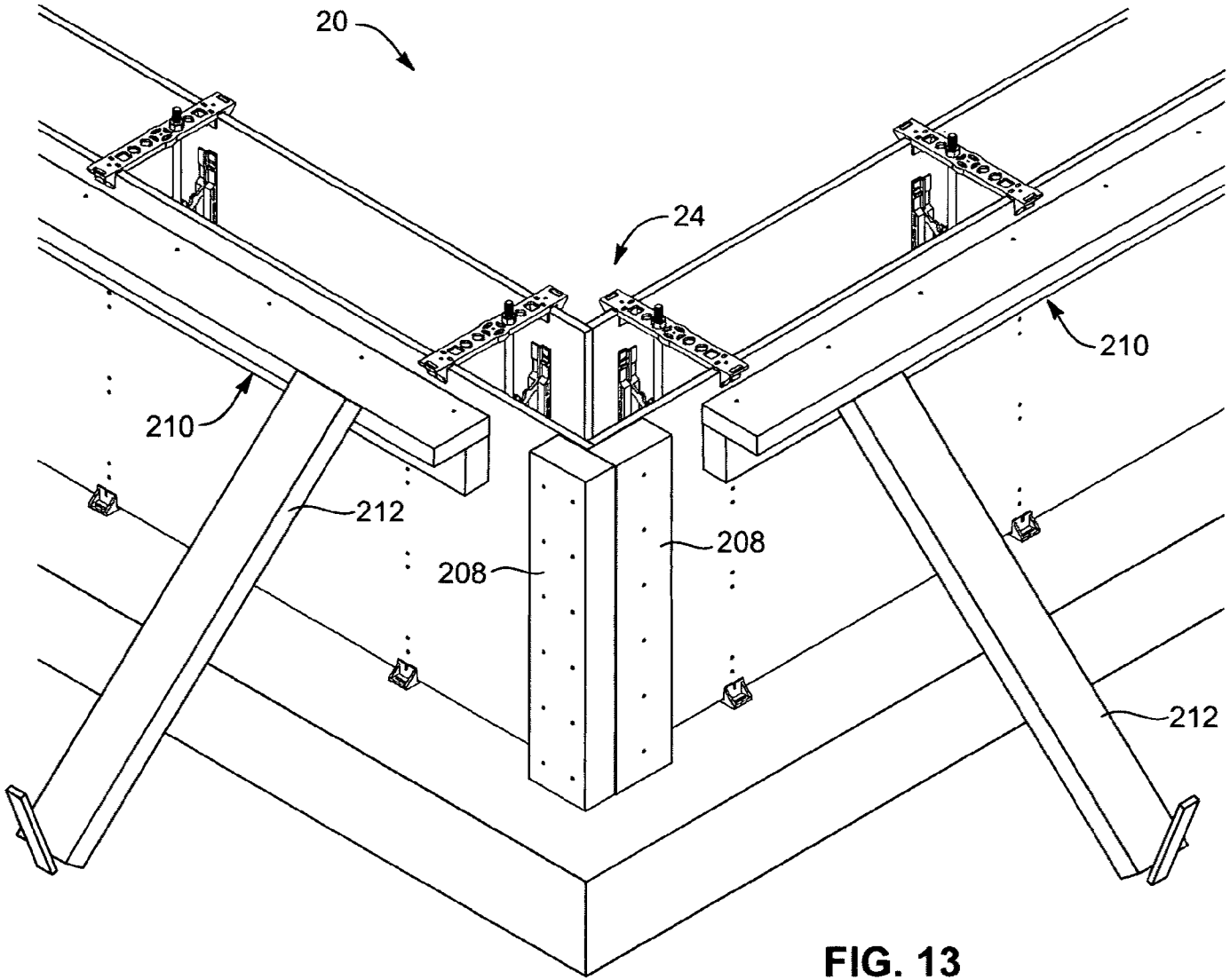
FIG. 13 is a perspective view of additional support structure for a wall corner, according to another embodiment of the present invention.

FIG. 13 also discloses another embodiment for attaching additional supporting structure along a length of an upper portion of the tie system 20 to keep the wall straight and plum, according to another aspect of the present invention. In particular, additional support structure can be provided to the concrete form by securing 2×4 beams 210 horizontally along an upper portion of the concrete forms and positioning beams 212 to extend between the ground and the horizontally extending beams in a diagonal manner, as depicted.

Figure 14:
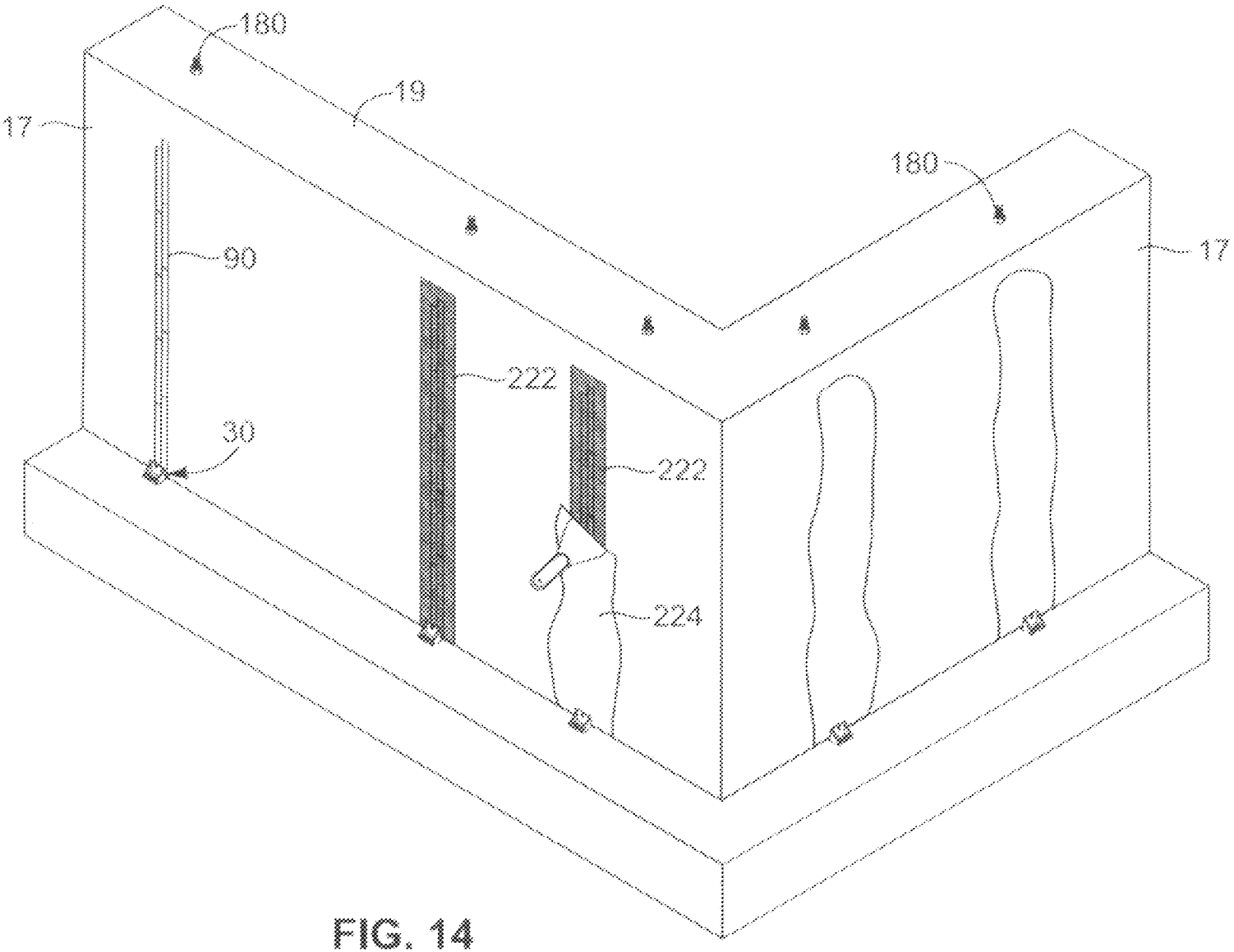
FIG. 14 is a perspective view of an exposed concrete wall after the panel structures are removed, depicting a covering and coating process of an exposed portion of the wall ties, according to an embodiment of the present invention.

Referring now to FIG. 14, there is disclosed a step for covering and coating an exposed portion of the wall ties in an exposed and hardened concrete wall 17, according to another aspect of the present invention. Once the forms have been built and provided the proper supporting structure, the concrete can be poured between the forms and left to set and, as previously set forth, within one to three hours, the screw from the lag whaler arrangement can be removed from the forms. Once the concrete is completely set, the forms can be removed, including the additional support structure, the panel structures and the finish ties. According to another advantageous aspect of the present invention, the panel structures and finish ties can then be re-used for another tie system or the panel structures can be employed for other portions of the residential or commercial building, such as for the roof or sub-floor. Therefore, the tie system of the present invention limits the waste of lumber and maximizes the use of materials.

As shown, a top portion 19 of the hardened concrete wall 17 can include an exposed portion of the anchor bolts 180 ready to receive the bottom portion of the structure (not shown) to be built thereon. Also, once the panel structures are removed, the outer surface of the wall ties 90 will be exposed on the concrete wall 17 along with a portion of the end portions of the base tie 30. To cover this exposed portion of the wall tie 90, a self-adhesive tape 222 can be applied thereto, such as a mesh tape. The self-adhesive tape 222 can then receive a base coat product 224. The base coat product can be any suitable exterior insulation finishing system ("E.I.F.S.") type product, such as, DRYVIT, PAREX, SYNERGY or FINESTONE products. This will provide a bridge over the exposed wall ties that provides a surface that can be plastered over or receive a water proofing product as typically employed on foundation walls.

Furthermore, in another aspect of the present invention, once the panel structures are removed from the hardened concrete wall 17, the exposed portion of the wall ties 90 can be used as anchoring points for other building materials. In particular, such exposed portion of the wall ties 90 in the concrete wall can be employed as a substrate to anchor a polymeric insulation building material thereto. The portion best suited to anchor into is the intermediate wall portion 108 being sized and configured thicker than other portions of the elongated wall portions (See FIG. 2). Polymeric building materials can include, but are not limited to, high density polystyrene foam, or any other suitable polymeric foam or building material typical to that used in insulation concrete forms. Of course, the exposed portion of the wall ties 90 can also be used to anchor other types of materials as well. In this manner, the tie system of the present invention can be employed to form concrete walls and obtain the advantages of an insulated wall without the high cost of the insulation concrete form systems.

Figure 15:
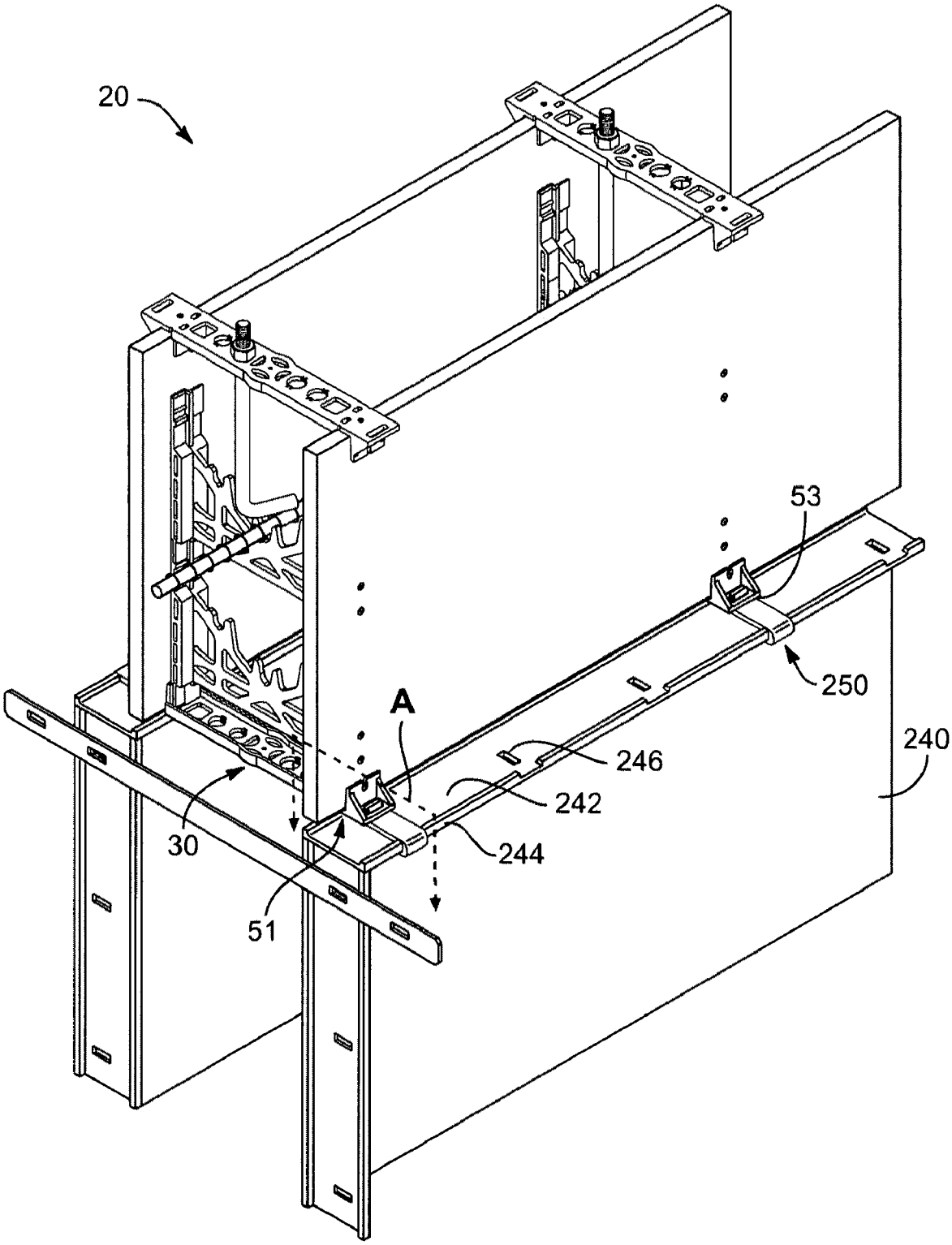
FIG. 15 is a perspective view of the tie system being utilized over traditional metal concrete forms, depicting a clip member interconnecting the metal concrete forms to the tie system, according to an embodiment of the present invention.
Figure 16:
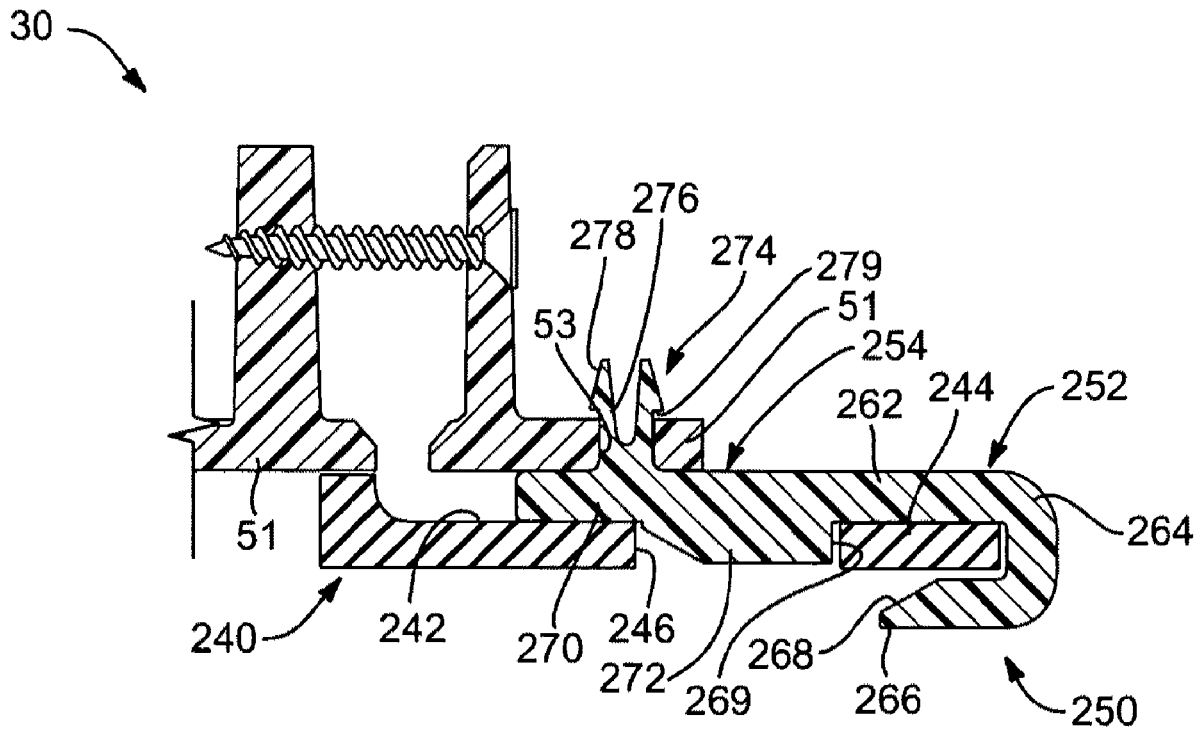
FIG. 16 is cross-sectional view, taken along line A, of the tie clip member and a portion of the base tie, depicting the clip member fastened to metal concrete forms, according to the present invention.

FIGS. 15 and 16 disclose another embodiment of the tie system 20 in conjunction with a clip member 250, according to the present invention. In particular, there is disclosed a clip member 250 that can be integrated with the base tie 30 of the present invention and attach to a top surface 242 of traditional metal forms 240. Such a clip member 250 can be employed with the tie system 20 of the present invention for increasing the height for a concrete wall than that which is available for a given metal form system.

The clip member 250 can include a form attachment portion 252 and a tie attachment portion 254. The form attachment portion 252 is sized and configured to attach to a portion, such as a top surface 242, of the metal forms 240. The form attachment portion 252 can include a first extension portion 262, a wrap portion 264 and a free end 266. The first extension portion 262 can be configured to extend outward from the tie attachment portion 254 to the wrap portion 264. The wrap portion 264 can be sized and configured to wrap around an edge 244 at the top surface 242 of the metal form 240. The free end 266 extends from the wrap portion 264 and can include a tapered lip 268. At an underside of the first extension portion 262, there is defined a recess 269 or groove configured to receive the edge 244 of the metal form 240 in conjunction with the wrap portion 264. With this arrangement, the clip member 250 can be readily attached to the edge 244 of the metal form by pulling and sliding the tapered free end 266 under the edge 244 and into the wrap portion 264 until the recess 269 of the first extension portion 262 engages such edge 244.

Now with reference to the tie attachment portion 254 of the clip member 250, such tie attachment portion 254 can be sized and configured to attach to a clip hole 53 in an end portion 51 of the base tie 30. The tie attachment portion 254 can include a second extension portion 270 with a clipping portion 274 extending upward therefrom and a lower portion 272. The second extension portion 270 is sized and configured to be disposed between a top surface 242 of the metal forms 240 and below the base tie 30. The clipping portion 274 can be sized and configured to extend through the clip hole 53 defined in the end portion 51 of the base tie 30. The lower portion 272 below the second extension portion 270 can be disposed within a hole 246 defined in the top surface 242 of the metal forms 240. The clipping portion 274 can include two upward extending portions 276 each with a tapered free end 278 and a back-stop 279. As such, once the clip member 250 is properly positioned and attached to the metal forms 240, the base tie 30 can be aligned such that the clipping portion 274 is inserted through the clip hole 53 in the base tie 30. As such insertion takes place, the tapered free ends 278 of the upward extending portion 276 squeeze or move together until the clipping portion 274 is fully inserted. The back-stop portion 279 of each upward extending portion 276 maintains the base tie 30 in proper position. Another clip member 250 should also be employed, as previously set forth, for the opposite side of the base tie 30 and each base tie 30 along the length of the metal forms 240. In this manner, the clip member 250 can be utilized with the tie system 20 to achieve greater concrete wall heights than that which is available for a given metal form 240. It should be noted that the base tie, in this aspect of the present invention, is positioned over the concrete footing (not shown) and, more specifically, is positioned over and above the concrete footing while being secured to the metal forms 240.

Furthermore, the tie system of the present invention can also be employed over a top portion of traditional wood forms, similar to that depicted in the previous embodiment. However, according to another embodiment, the base tie 30 can be positioned over (and above) the footing and fastened to the top surface of traditional wood forms via a base securing hole 83 defined in each of the channels 80 of the first end portion 50 and the second end portion 52 of the base tie 30, as depicted in FIGS. 2 and 2A. As will be readily understood by one of ordinary skill in the art, the base tie 30 can be positioned and secured on the top surface of the traditional wood forms via base securing hole 83 and, then built upon with the tie system, as set forth herein.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A tie system configured to support removable parallel panel structures over a footing, the panel structures including a first panel structure and a second panel structure configured to receive a hardenable pourable building material over the footing, the tie system comprising:

a base tie having a longitudinal length including an elongated portion extending between a first end portion and a second end portion, the base tie having an under-side surface extending continuously and planar along the longitudinal length and as the underside surface of each of the elongated portion and the first and second end portions, the first end portion and the second end portion each including an attachment portion configured to extend vertically upward and perpendicular relative to the longitudinal length of the base tie, the base tie configured to be oriented laterally over a length of the footing such that the under-side surface is positioned to seat directly against an upper surface of the footing; and a wall tie including a first elongated wall portion and a second elongated wall portion with a cross-member portion rigidly connected and extending therebetween, the first elongated wall portion and the second elongated wall portion being configured to extend vertically from and attach to the attachment portion of the first end portion and the second end portion, respectively, of the base tie, the first elongated wall portion having a first planar surface and the second elongated wall portion having a second planar surface, the first planar surface facing directly opposite from the second planar surface, the first planar surface configured to be fastened to an inner surface of the first panel structure and the second planar surface configured to be fastened to an inner surface of the second panel structure.

2. The tie system of claim 1, wherein the wall tie comprises a lower attachment portion and an upper attachment portion at respective lower and upper ends of the first elongated wall portion and the second elongated wall portion, the upper attachment portion configured to mate with the lower attachment portion of another wall tie to, thereby, facilitate building a vertically extending tie stack.

3. The tie system of claim 2, wherein the first end portion and the second end portion each include a first channel and a second channel, respectively, defined therein and extending laterally with respect to the longitudinal length of the base tie, the first channel and the second channel being configured to receive the first panel structure and the second panel structure, respectively, so that the first panel structure extends parallel to the second panel structure with the elongated portion of the base tie and the tie stack being positioned therebetween.

4. The tie system of claim 3, further comprising a finish tie having an elongated portion extending between a first end portion and a second end portion, each of the first end portion and the second end portion defining a first channel and a second channel therein, the first channel and the second channel of the finish tie being configured to be positioned over and maintained on the first panel structure and the second panel structure, respectively.

5. The tie system of claim 1, wherein the first end portion and the second end portion each include a channel defined therein, each channel being configured to receive one of the first and second panel structures to define a portion of the removable parallel panel structures.

6. The tie system of claim 1, further comprising a clip member including a tie attach portion and a form attach portion, the tie attach portion configured to removably attach to one of the first end portion or the second end portion of the base tie, the form attach portion configured to removably attach to a top portion of traditional concrete forms, the base tie being configured to be positioned on the traditional concrete forms and over the footing.

7. The tie system of claim 1, wherein the cross-member portion comprises a rebar holder configured to position and align rebar therein.

8. The tie system of claim 1, wherein the attachment portion of the first end portion and the second end portion of the base tie comprises an engaging portion configured to removably lock with the wall tie.

9. The tie system of claim 8, wherein the engaging portion comprises a protrusion configured to engage with a groove defined in the wall tie.

10. The tie system of claim 1, wherein the attachment portion of the first end portion and the second end portion of the base tie comprises a first attachment portion and a second attachment portion each extending upward and extending laterally with respect to the elongated portion, the first attachment portion and the second attachment portion having an off-set arrangement.

11. The tie system of claim 10, wherein the first elongated wall portion and the second elongated wall portion include a first lower attachment portion and a second lower attachment portion, respectively, the first lower attachment portion and the second lower attachment portion sized and configured to engage with the first attachment portion and the second attachment portion, respectively, of the base tie.

12. The tie system of claim 11, wherein the first lower attachment portion and the second lower attachment portion each extend downward in an off-set manner to mate with the off-set arrangement of the first attachment portion and the second attachment portion of the base tie.

13. A tie system configured to support a first panel structure and a second panel structure for forming a wall from a hardenable pourable building material, the tie system comprising:

multiple ties configured to be directly interconnected into a vertically extending tie stack such that multiple tie stacks can be positioned over a footing in a spaced and separate arrangement, the multiple tie stacks configured to extend substantially perpendicular between substantially parallel panel structures of the first and second panel structures, each of the tie stacks including:

a base portion having a longitudinal length including an elongated portion extending between a first end portion and a second end portion, the first end portion having a first attachment portion and a first support portion to define a first channel therebetween configured to receive the first panel structure, the second end portion having a second attachment portion and a second support portion to define a second channel therebetween configured to receive the second panel structure, the first attachment portion and the second attachment portion configured to extend vertically upward and perpendicular relative to the longitudinal length of the base portion; and a wall portion including a first elongated wall portion and a second elongated wall portion with a cross-member portion rigidly connected and extending therebetween, the first elongated wall portion configured to extend vertically from and directly interconnect to the first attachment portion of the base portion and the second elongated wall portion configured to extend vertically from and directly interconnect to the second attachment portion of the base portion, the first elongated wall portion having a first planar surface and the second elongated wall portion having a second planar surface, the first planar surface facing directly opposite from the second planar surface, the first planar surface of the first elongated wall portion being configured to be directly fastened to the first panel structure and the second elongated wall portion being configured to be directly fastened to the second panel structure.

14. The tie system of claim 13, wherein the wall portion of each of the tie stacks comprises multiple wall ties each including the first elongated wall portion and the second elongated wall portion interconnected in a vertical stacked arrangement.

15. The tie system of claim 13, wherein the cross-member in each of the tie stacks comprises a rebar holder configured to carry rebar horizontally over the footing and along corresponding cross-members in each of the spaced multiple tie stacks.

16. The tie system of claim 13, further comprising a finish tie comprising a first end portion and a second end portion, the first end portion of the finish tie including a first channel defined therein and the second end portion of the finish tie including a second channel defined therein, the first channel of the finish tie and the second channel of the finish tie being configured to be positioned over and receive the first panel structure and the second panel structure, respectively.

17. A wall forming system configured to interconnect substantially parallel panel structures including a first panel structure and a second panel structure in preparation to pouring a hardenable pourable building material between the substantially parallel panel structures over a footing, the wall forming system comprising:

a plurality of base ties each having a longitudinal length including an elongated portion extending between a first end portion and a second end portion, each of the plurality of base ties including an underside surface extending continuously and planar along the longitudinal length and as the underside surface of each of the elongated portion and the first and second end portions, the underside surface of each of the plurality of base ties configured to be directly secured to an upper surface of the footing such that the plurality of base ties are oriented laterally along a length of a footing in a spaced arrangement; and a plurality of wall ties, each wall tie being configured to be interconnected to another wall tie to assemble multiple wall tie stacks, each wall tie stack configured to be stacked vertically to one base tie of the plurality of base ties;

wherein each of the plurality of wall ties includes a first elongated wall portion and a second elongated wall portion with a cross-member portion rigidly connected and extending between the first and second elongated wall portions, the first elongated wall portion including a first planar surface and the second elongated wall portion including a second planar surface, the first planar surface facing directly opposite from the second planar surface, the first and second elongated wall portions each configured to be longitudinally oriented in a substantially vertical direction, and each of the first planar surface and the second planar surface configured to be fastened directly to an inside facing surface of the first panel structure and an inside facing surface of the second panel structure, respectively, such that each wall tie is positioned entirely between the parallel panel structures.

18. The wall forming system of claim 17, wherein the first end portion and the second end portion of each of the plurality of base ties includes a first attachment portion and a second attachment portion, respectively, the first and second attachment portions configured to extend vertically upward and perpendicular relative to the longitudinal length of each of plurality of base ties.

19. The wall forming system of claim 18, wherein the first elongated wall portion of each of the plurality of wall ties extends between a first lower attachment portion and a first upper attachment portion and the second elongated wall portion of each of the plurality of wall ties extends between a second lower attachment portion and a second upper attachment portion, the first and second lower attachment portions of each of the plurality of wall ties configured to respectively couple to at least one of (a) the first and second attachment portions of one of the plurality of base ties and (b) the first and second upper attachment portions of one of the plurality of wall ties.

* * * * *